US010937439B2

(12) United States Patent
Cheung et al.

(10) Patent No.: US 10,937,439 B2
(45) Date of Patent: Mar. 2, 2021

(54) METHOD AND APPARATUS FOR DIRECTIONAL SOUND APPLICABLE TO VEHICLES

(71) Applicant: IpVenture, Inc., San Jose, CA (US)

(72) Inventors: Kwok Wai Cheung, Tai Po (HK); Peter P. Tong, Mountain View, CA (US); C. Douglass Thomas, Saratoga, CA (US)

(73) Assignee: IpVenture, Inc., San Jose, CA (US)

( * ) Notice: Subject to any disclaimer, the term of this patent is extended or adjusted under 35 U.S.C. 154(b) by 0 days.

(21) Appl. No.: 16/703,788

(22) Filed: Dec. 4, 2019

(65) Prior Publication Data

US 2020/0105288 A1 Apr. 2, 2020

Related U.S. Application Data

(63) Continuation of application No. 15/667,742, filed on Aug. 3, 2017, now Pat. No. 10,522,165, which is a (Continued)

(51) Int. Cl.
*G10L 21/0208* (2013.01)
*H04R 25/00* (2006.01)
(Continued)

(52) U.S. Cl.
CPC ..... *G10L 21/0208* (2013.01); *H04R 1/403* (2013.01); *H04R 25/405* (2013.01);
(Continued)

(58) Field of Classification Search
CPC ..... H04R 24/403; H04R 27/00; H04R 2201/401; H04R 2217/03; H04R 1115/65;
(Continued)

(56) References Cited

U.S. PATENT DOCUMENTS 3,942,139 A 3/1976 Cooper et al.
3,974,335 A 8/1976 Blackledge
(Continued)

FOREIGN PATENT DOCUMENTS

JP 01109898 A 4/1989
KR 2001-0091117 A 10/2001

OTHER PUBLICATIONS

Office Action for U.S. Appl. No. 10/826,529, dated Jan. 3, 2007.
(Continued)

*Primary Examiner* — Melur Ramakrishnaiah

(57) ABSTRACT

Different embodiments of methods and apparatus to produce audio output signals are disclosed. In one embodiment, an ultrasonic speaker outputting ultrasonic signals can be transformed into first audio output signals, which are directional. A non-ultrasonic speaker can output second audio output signals. The embodiment can be configured to output the first audio output signals or the second audio output signals in a vehicle. Another embodiment can be configured to output the first and the second audio output signals together. Yet another embodiment can be configured to be personalized to hearing characteristics of a user, or to depend on sound level of an environment of the user. One embodiment can include a directional speaker attached to a vehicle, with its output steerable towards a user in the vehicle.

20 Claims, 31 Drawing Sheets

Related U.S. Application Data continuation of application No. 14/482,049, filed on Sep. 10, 2014, now Pat. No. 9,741,359, which is a continuation of application No. 12/930,344, filed on Jan. 4, 2011, now Pat. No. 8,849,185, which is a continuation-in-part of application No. 12/462,601, filed on Aug. 6, 2009, now Pat. No. 8,208,970, which is a continuation of application No. 11/893,835, filed on Aug. 16, 2007, now Pat. No. 7,587,227, which is a continuation of application No. 10/826,529, filed on Apr. 15, 2004, now Pat. No. 7,269,452.

(60) Provisional application No. 61/335,361, filed on Jan. 5, 2010, provisional application No. 60/462,570, filed on Apr. 15, 2003, provisional application No. 60/469,221, filed on May 12, 2003, provisional application No. 60/493,441, filed on Aug. 8, 2003.

(51) Int. Cl.
*H04R 1/40* (2006.01)
*H04R 3/12* (2006.01)

(52) U.S. Cl.
CPC ..... *H04R 3/12* (2013.01); *H04R 2201/023* (2013.01); *H04R 2217/03* (2013.01)

(58) Field of Classification Search
CPC .. H04R 1/403; H04R 3/12; H04S 1/00; H04S 3/00; H04M 1/03; H04M 1/19; H04M 1/0214
USPC ..... 381/98, 77, 182, 111; 310/311
See application file for complete search history.

(56) References Cited

U.S. PATENT DOCUMENTS 4,006,308 A 2/1977 Ponsgen
4,128,738 A 12/1978 Gallery
4,292,679 A 9/1981 Kondo et al.
4,476,571 A 10/1984 Tokumo et al.
4,622,440 A 11/1986 Slavin
4,625,318 A 11/1986 Snyder
4,823,908 A 4/1989 Tanaka
4,955,729 A 9/1990 Marx
5,313,663 A 5/1994 Norris
5,321,758 A 6/1994 Charpentier et al.
5,357,578 A 10/1994 Taniishi
5,450,494 A 9/1995 Okubo et al.
5,481,616 A 1/1996 Freadman
5,495,534 A 2/1996 Inanaga et al.
5,519,781 A 5/1996 Kukurudza
5,526,411 A 6/1996 Krieter
5,572,575 A 11/1996 Yamamoto et al.
5,588,041 A 12/1996 Meyer et al.
5,648,824 A 7/1997 Dunn et al.
5,666,424 A 9/1997 Fosgate et al.
5,682,157 A 10/1997 Asmussen et al.
5,764,595 A 6/1998 Power
5,764,782 A 6/1998 Hayes
5,777,665 A 7/1998 McNelley et al.
5,793,875 A 8/1998 Lehr et al.
5,802,190 A 9/1998 Ferren
5,819,183 A 10/1998 Voroba et al.
5,828,768 A 10/1998 Eatwell et al.
5,835,732 A 11/1998 Kikinis et al.
5,870,484 A 2/1999 Greenberger
5,943,430 A 8/1999 Saitoh
6,011,855 A 1/2000 Selfridge et al.
6,041,657 A 3/2000 Sutherland
6,052,336 A 4/2000 Lowrey, III
6,058,315 A 5/2000 Clark
6,086,541 A 7/2000 Rho
6,151,398 A 11/2000 Norris
6,163,711 A 12/2000 Juntunen et al.
6,169,813 B1 1/2001 Richardson et al.
6,243,472 B1 6/2001 Bilan et al.
6,259,731 B1 7/2001 Dent et al.
6,275,596 B1 8/2001 Fretz et al.
6,279,946 B1 8/2001 Johnson et al.
6,322,521 B1 11/2001 Hou
6,363,139 B1 3/2002 Zurek et al.
6,445,804 B1 * 9/2002 Hirayanagi ..... H04R 3/00 381/117
6,453,045 B1 9/2002 Zurek et al.
6,477,258 B1 11/2002 Watson et al.
6,484,040 B1 11/2002 Wang
6,496,205 B1 12/2002 White et al.
6,498,970 B2 12/2002 Colmenarez et al.
6,512,826 B1 1/2003 Kim
6,535,612 B1 3/2003 Croft, III et al.
6,539,100 B1 3/2003 Amir et al.
6,556,687 B1 4/2003 Manabe
6,584,205 B1 6/2003 Croft, III et al.
6,591,085 B1 7/2003 Grady
6,594,367 B1 7/2003 Marash et al.
6,631,196 B1 10/2003 Taenzer et al.
6,643,377 B1 * 11/2003 Takahashi ..... H04S 1/00 181/155
6,650,755 B2 11/2003 Vaudrey et al.
6,671,494 B1 12/2003 James
6,678,381 B1 1/2004 Manabe
6,710,797 B1 3/2004 McNelley et al.
6,771,785 B2 8/2004 Pompei
6,807,281 B1 * 10/2004 Sasaki ..... H04R 1/403 381/111
6,895,261 B1 5/2005 Palamides
6,914,991 B1 7/2005 Pompei
7,013,009 B2 3/2006 Warren
7,016,504 B1 3/2006 Shennib
7,062,050 B1 6/2006 Pompei
7,106,180 B1 9/2006 Pompei
7,269,452 B2 9/2007 Cheung
7,376,236 B1 5/2008 Norris et al.
7,388,962 B2 6/2008 Cheung
7,587,227 B2 9/2009 Cheung et al.
7,596,228 B2 9/2009 Pompei
7,657,044 B2 2/2010 Pompei
7,801,570 B2 9/2010 Cheung et al.
8,208,970 B2 6/2012 Cheung et al.
8,582,789 B2 11/2013 Cheung et al.
8,849,185 B2 9/2014 Cheung et al.
8,953,821 B2 2/2015 Pompei
9,741,359 B2 8/2017 Cheung et al.
10,522,165 B2 12/2019 Cheung et al.
2001/0007591 A1 7/2001 Pompei
2001/0038698 A1 11/2001 Breed et al.
2001/0055397 A1 12/2001 Norris et al.
2002/0005777 A1 1/2002 Rodewald et al.
2002/0008718 A1 1/2002 Obradovich
2002/0012441 A1 1/2002 Matsunaga et al.
2002/0048382 A1 4/2002 Hou
2002/0048385 A1 4/2002 Rosenberg
2002/0054689 A1 5/2002 Zhang et al.
2002/0070881 A1 6/2002 Marcarelli et al.
2002/0090099 A1 7/2002 Hwang
2002/0090103 A1 7/2002 Calisto, Jr.
2002/0136414 A1 9/2002 Jordan et al.
2002/0141599 A1 10/2002 Trajkovic et al.
2002/0149705 A1 10/2002 Allen et al.
2002/0183648 A1 12/2002 Hou
2002/0191807 A1 12/2002 Asada et al.
2003/0009248 A1 1/2003 Wiser et al.
2003/0009329 A1 1/2003 Stahl et al.
2003/0026439 A1 2/2003 Yamamoto et al.
2003/0035552 A1 2/2003 Kolano et al.
2003/0064746 A1 4/2003 Rader et al.
2003/0069000 A1 * 4/2003 Kindo ..... H04B 1/3877 455/345
2003/0091200 A1 5/2003 Pompei
2003/0092377 A1 5/2003 Hill
2003/0118198 A1 6/2003 Croft, III et al.
2003/0156495 A1 8/2003 Haase et al.

(56) References Cited

U.S. PATENT DOCUMENTS

| | | | | |
|---|---|---|---|---|
| 2003/0174242 | A1 | 9/2003 | Carmi et al. | |
| 2003/0182104 | A1 | 9/2003 | Muesch | |
| 2004/0005069 | A1 | 1/2004 | Buck | |
| 2004/0042615 | A1 | 3/2004 | Scholte | |
| 2004/0052387 | A1 | 3/2004 | Norris et al. | |
| 2004/0114770 | A1 | 6/2004 | Pompei | |
| 2004/0114772 | A1 | 6/2004 | Zlotnick | |
| 2004/0124739 | A1* | 7/2004 | Li | G10K 11/34 310/311 |
| 2004/0170086 | A1 | 9/2004 | Mayer et al. | |
| 2004/0202339 | A1 | 10/2004 | O'Brien, Jr. et al. | |
| 2004/0204168 | A1 | 10/2004 | Laurila | |
| 2004/0208324 | A1 | 10/2004 | Cheung et al. | |
| 2004/0208325 | A1 | 10/2004 | Cheung et al. | |
| 2004/0208333 | A1 | 10/2004 | Cheung et al. | |
| 2004/0209654 | A1 | 10/2004 | Cheung et al. | |
| 2005/0009583 | A1 | 1/2005 | Cheung et al. | |
| 2006/0210090 | A1 | 9/2006 | Shennib | |
| 2006/0233404 | A1 | 10/2006 | Croft et al. | |
| 2006/0291667 | A1 | 12/2006 | Watanabe et al. | |
| 2007/0189548 | A1 | 8/2007 | Croft, III | |
| 2007/0211574 | A1 | 9/2007 | Croft, III | |
| 2007/0287516 | A1 | 12/2007 | Cheung | |
| 2008/0279410 | A1 | 11/2008 | Cheung et al. | |
| 2009/0298430 | A1 | 12/2009 | Cheung et al. | |
| 2010/0080409 | A1 | 4/2010 | Xu et al. | |
| 2011/0103614 | A1 | 5/2011 | Cheung et al. | |
| 2014/0376745 | A1 | 12/2014 | Cheung et al. | |
| 2018/0018988 | A1 | 1/2018 | Cheung et al. | |

OTHER PUBLICATIONS

Notice of Allowance for U.S. Appl. No. 10/826,529 dated Jun. 12, 2007.
Supplemental Notice of Allowance for U.S. Appl. No. 10/826,529, dated Jul. 30, 2007.
Office Action for U.S. Appl. No. 11/893,835, dated Oct. 21, 2008.
Notice of Allowance for U.S. Appl. No. 11/893,835, dated May 19, 2009.
Supplemental Notice of Allowance for U.S. Appl. No. 11/893,835, dated Jun. 8, 2009.
Supplemental Notice of Allowance for U.S. Appl. No. 11/893,835, dated Jun. 15, 2009.
Office Action for U.S. Appl. No. 12/462,601, dated Nov. 9, 2011.
Notice of Allowance for U.S. Appl. No. 12/462,601, dated Mar. 29, 2012.
Office Action for U.S. Appl. No. 12/930,344, dated Mar. 5, 2014.
Notice of Allowance for U.S. Appl. No. 12/930,344, dated Jun. 3, 2014.
Office Action for U.S. Appl. No. 14/482,049, dated May 9, 2016.
Notice of Allowance for U.S. Appl. No. 14/482,049, dated Sep. 16, 2016.
Notice of Allowance for U.S. Appl. No. 14/482,049, dated Jan. 13, 2017.
Notice of Allowance for U.S. Appl. No. 14/482,049, dated Apr. 10, 2017.
Non-Final Office Action for U.S. Appl. No. 15/667,742, dated Jan. 23, 2018.
Notice of Allowance for U.S. Appl. No. 15/667,742, dated Aug. 9, 2018.
Non-Final Office Action for U.S. Appl. No. 15/667,742, dated Oct. 30, 2018.
Notice of Allowance for U.S. Appl. No. 15/667,742, dated Jan. 9, 2018.
Non-Final Office Action for U.S. Appl. No. 15/667,742, dated Mar. 5, 2019.
Notice of Allowance for U.S. Appl. No. 15/667,743, dated Sep. 20, 2019.
Office Action, re: CN 200480010388.8, Chinese Patent Office, dated Apr. 17, 2009, 8 pages.
Second Office Action re: CN200480010388.8 Chinese Patent Office, dated Sep. 4, 2009, 6 pages.
Third Office Action re: CN200480010388.8 Chinese Patent Office, dated Jan. 22, 2010, 9 pages.
Fourth Office Action re: CN200480010388.8 Chinese Patent Office, dated Jul. 25, 2012, 4 pages.
Fifth Office Action re: CN200480010388.8 Chinese Patent Office, dated Oct. 26, 2012, 5 pages.
PCT International Search Report, RE: PCT/US04/11972, dated Jan. 31, 2005.
PCT Written Opinion of the International Searching Authority, RE: PCT/US04/11972, dated Jan. 31, 2005.
American Technology Corporation, HyperSonic Sound, Jan. 22, 2002, www.atcsd.com.
American Technology Corporation, "Technology Introduction," 2001, pp. 1-19.
American Technology Corporation, "Theory, History, and the Advancement of Parametric Loudspeakers—A Technology Overview," White Paper, 2002, pp. 1-27.
American Technology Corporation, "HSS Directed Audio Sound System, Model Series: 220," Product Information, 2003.
American Technology Corporation,"Technology Licensing—HyperSonic Sound," 2003, pp. 1-3.
Aoki, K. et al., "Parametric Loudspeaker-Applied Examples," Electronics and Communications in Japan, Part 3, vol. 77, No. 1, 1994, pp. 64-74.
Aoki, K. et al., "Self-demodulation of a plane-wave—Study on primary wave modulation for wideband signal transmission, " J. Acoust. Soc. Jpn., pp. 349-356, 1984 (with English abstract).
Averkiou, M.A. et al., "Self-demodulation of amplitude- and frequency-modulated pulses in a thermoviscous fluid," The Journal of the Acoustical Society of America, 94(5), Nov. 1993, pp. 2876-2883.
Baker, A. C., "Nonlinear pressure fields due to focused circular apertures," The Journal of the Acoustical Society of America, 91(2), Feb. 1992, pp. 713-717.
Bennett, M. B. et al., "Parametric array in air," The Journal of the Acoustical Society of America, vol. 57, No. 3, Mar. 1975, pp. 562-568.
Berktay, H.O., "Possible Exploitation of Non-Linear Acoustics in Underwater Transmitting Applications," J. Sound Vib. (1965) 2(4), 435-461.
Berntsen, J. et al., "Interaction of sound waves. Part IV: Scattering of sound by sound," The Journal of the Acoustical Society of America, 86(5), Nov. 1989, pp. 1968-1983.
Berntsen, J. et al., "Nearfield of a large acoustic transducer. Part Iv: Second harmonic and sum frequency radiation," the Journal of the Acoustical Society of America, 75(5), May 1984, pp. 1383-1391.
Blackstock, David T., "Audio Application of the Parametric Array," J. Acoust. Soc. Am, vol. 102, No. 5, Pt. 2, Nov. 1997, p. 3106.
Brain, Marshall, How USB Ports Work, Oct. 11, 2002, www.howstuffworks.com/usb.
Darvennes, C. M. et al., "Effects of absorption on the nonlinear interaction of sound beams," The Journal of the Acoustical Society of America, 89(3), Mar. 1991, pp. 1028-1036.
Davy, B. A., "Acoustic Self-demodulation of Pre-distorted Pulsed Carriers," Masters' Thesis, University of Texas Austin, 1972, title page, pp. i-ix, and 1-57.
Darvennes, C. M., et al., "Scattering of sound by sound from two Gaussian beams," The Journal of the Acoustical Society of America, 87(5), May 1990, pp. 1955-1964.
Druyvesteyn, W. F. et al., "Personal Sound," J. Audio Eng. Soc., vol. 45, No. 9, Sep. 1997, pp. 685-701.
Garrett, G. et al., "Nearfield of a large acoustic transducer, Part II: Parametric radiation," The Journal of the Acoustical Society of America, 74(3), Sep. 1983, pp. 1013-1020.
Garrett, G., et al., "Nearfield of a large acoustic transducer. Part III: General results," The Journal of the Acoustical Society of America, 75(3), Mar. 1984, pp. 769-779.
Gol'dberg, Z.A., "Certain Second-Order Quantities in Acoustics," SOV Phys Acoust, vol. 3, 1957, pp. 157-162.
Greenspan, M., "Piston radiator: Some extensions of the theory," The Journal of the Acoustical Society of America, 65(3), Mar. 1979, pp. 608-621.

(56) References Cited

OTHER PUBLICATIONS

Havelock, D. I., "Directional Loudspeakers Using Sound Beams," J. Audio Eng. Soc., vol. 48, No. 10, Oct. 2000, pp. 908-916.
Holosonic Research Labs, Inc. 2002, "Audio Spotlight—Put sound where you want it," www.holosonics.com/technology.html (downloaded Jan. 18, 2004).
Kamakura, T. et al, "Development of Parametric Loudspeaker for Practical Use", Proceedings of the 10th International Symposium on Nonlinear Acoustics, pp. 147-150, 1984.
Kamakura, T. et al., "Suitable Modulation of the Carrier Ultrasound for a Parametric Loudspeaker," ACUSTICA, vol. 73 (1991), pp. 215-217.
Kamakura, T. et al., "Harmonic generation in finite amplitude sound beams from a rectangular aperture source," The Journal of the Acoustical Society of America, 91(6), Jun. 1992, pp. 3144-3151.
Kamakura, T., et al., "Nonlinearly generated spectral components in the nearfield of a directive sound source," The Journal of the Acoustical Society of America, 85(6), Jun. 1989, pp. 2331-2337.
Kim, W. et al, "Audio Application of the Parametric Array—Implementation through a Numerical Model," presented at the 113th Convention of the Audio Engineering Society (AES), paper 5652, Oct. 2002, pp. 1-16.
Kim, Y.W. et al., "Novel Preprocessing Technique to Improve Harmonic Distortion in Airborne Parametric Array," ICSP '02 Proceedings, IEEE 2002, pp. 1815-1818.
Kite, T.D. et al., "Parametric Array in Air: Distortion Reduction by Preprocessing," Proceedings of the 16th International Congress on Acoustics and the 135th Meeting of the Acoustical Society of America, Seattle, WA, Jun. 1998, pp. 1091-1092.
Kuznetsov, V. P., "Equations of Nonlinear Acoustics," Soviet Physics-Acoustics, vol. 16, No. 4, Apr.-Jun. 1971, pp. 467-470.
Lawton, B. W., "Damage to human hearing by airborne sound of a very high frequency or ultrasonic frequency," Institute of Sound and Vibration Research, Contract Research Report 343/2001, 2001, pp. 1-77.
Lucas, B. G., et al., "Field of a parametric focusing source," The Journal of the Acoustical Society of America, 73 (6), Jun. 1983, pp. 1966-1971.
Lucas, B. G., et al., "The field of a focusing source," The Journal of the Acoustical Society of America, 72(4), Oct. 1982, pp. 1289-1296.
Maney, K., "Sound technology turns the way you hear on its ear," USA Today, May 2003, pp. 1-4.
Marculescu, D. et al., "Ready to Ware," IEEE Spectrum, Oct. 2003, pp. 28-32.
Meyer, J., "Microphone Array for Hearing Aids taking into Account the Scattering of the Head," 2001 IEEE Workshop on Applications of Signal Processing to Audio and Acoustics, Oct. 21-24, 2001, pp. 27-30.
Muir, T.G. et al., "Parametric Acoustic Transmitting Arrays," The Journal of the Acoustical Society of America, vol. 52, No. 5, Part 2, 1972, pp. 1481-1486.
Nextel Communications, i60c Phone User's Guide, 2002, pp. 6, 65, 66, 135-137.
Nextel i60c Phone Details, http://nextelonline.nextel.com, downloaded Apr. 22, 2003, pp. 1-2.
Nextel-Direct Connect, http://nextelonline.nextel.com/services/directconnect-popup.html, downloaded Apr. 22, 2003, p. 1.
Palm™ m515 Handheld, Palm Store of Yahoo! Shopping, downloaded Apr. 23, 2003, pp. 1-2.
Palm™ PalmModem® Connectivity Kit, Palm Store of Yahoo! Shopping, downloaded Apr. 23, 2003, pp. 1-2.
Palm™ Tungsten™ C Handheld, Palm Store of Yahoo! Shopping, downloaded Apr. 23, 2003, pp. 1-3.
Palm™ Zire™ 71 Handheld, Palm Store of Yahoo! Shopping, downloaded Apr. 23, 2003, pp. 1-3.
Pompei, F. J., "The Use of Airborne Ultrasonics for Generating Audible Sound Beams," J. Audio Eng. Soc., vol. 47, No. 9, Sep. 1999, pp. 726-731.
"The Cookie-Size Concert Hall," Business Week, Dec. 2, 1996, 5 pages.
Tjotta, J. N. et al., "Propagation and interaction of two collinear finite amplitude sound beams," The Journal of the Acoustical Society of America, 88(6), Dec. 1990, pp. 2859-2870.
Vyas, A. L., et al., "Design Considerations of Parametric Arrays," IEEE Proceedings of the 1998 International Symposium on Underwater Technology, Apr. 15-17, 1998, pp. 98-102.
Westervelt, P.J. "Parametric Acoustic Array," The Journal of the Acoustical Society of America, vol. 35, No. 4, Apr. 1963, pp. 535-537.
Yoneyama, M., et al., "The audio spotlight: An application of nonlinear interaction of sound waves to a new type of loudspeaker design," The Journal of the Acoustical Society of America, 73(5), May 1983, pp. 1532-1536.
Zabolotskaya, E. A., et al., "Quasi-plane Waves in the Nonlinear Acoustics of Confined Beams," Soviet Physics-Acoustics, vol. 15, No. 1, Jul.-Sep. 1969, pp. 35-40.
Zemanek, J. "Beam Behavior within the Nearfield of a Vibrating Piston," The Journal of the Acoustical Society of America, vol. 42, No. 1 (Part 2), 1971, pp. 181-191.

* cited by examiner

METHOD AND APPARATUS FOR DIRECTIONAL SOUND APPLICABLE TO VEHICLES

This application is a continuation of U.S. patent application Ser. No. 15/667,742, filed on Aug. 3, 2017, now U.S. Pat. No. 10,522,165, and entitled "METHOD AND APPARATUS FOR ULTRASONIC DIRECTIONAL SOUND APPLICABLE TO VEHICLES," which is hereby incorporated herein by reference, and which application is a continuation of U.S. patent application Ser. No. 14/482,049, filed on Sep. 10, 2014, now U.S. Pat. No. 9,741,359, and entitled "HYBRID AUDIO DELIVERY SYSTEM AND METHOD THEREFOR," which is hereby incorporated herein by reference, which application is a continuation of U.S. patent application Ser. No. 12/930,344, filed on Jan. 4, 2011, now U.S. Pat. No. 8,849,185, and entitled "HYBRID AUDIO DELIVERY SYSTEM AND METHODS THEREFOR," which is hereby incorporated herein by reference, which application claims priority of U.S. Provisional Patent Application No. 61/335,361, filed Jan. 5, 2010, and entitled "HYBRID AUDIO DELIVERY SYSTEM AND METHOD THEREFOR," which is hereby incorporated herein by reference.

U.S. patent application Ser. No. 12/930,344, filed on Jan. 4, 2011, and entitled "HYBRID AUDIO DELIVERY SYSTEM AND METHOD THEREFOR," is also a continuation in part of U.S. patent application Ser. No. 12/462,601, filed Aug. 6, 2009, now U.S. Pat. No. 8,208,970, and entitled "DIRECTIONAL COMMUNICATION SYSTEMS," which is hereby incorporated herein by reference, which application is a continuation of U.S. patent application Ser. No. 11/893,835, filed Aug. 16, 2007, now U.S. Pat. No. 7,587,227, and entitled "DIRECTIONAL WIRELESS COMMUNICATION SYSTEMS," which is hereby incorporated herein by reference, which application is a continuation of U.S. patent application Ser. No. 10/826,529, filed Apr. 15, 2004, now U.S. Pat. No. 7,269,452, and entitled "DIRECTIONAL WIRELESS COMMUNICATION SYSTEMS," which is hereby incorporated herein by reference, and claims priority of: (i) U.S. Provisional Patent Application No. 60/462,570, filed Apr. 15, 2003, and entitled "WIRELESS COMMUNICATION SYSTEMS OR DEVICES, HEARING ENHANCEMENT SYSTEMS OR DEVICES, AND METHODS THEREFOR," which is hereby incorporated herein by reference; (ii) U.S. Provisional Patent Application No. 60/469,221, filed May 12, 2003, and entitled "WIRELESS COMMUNICATION SYSTEMS OR DEVICES, HEARING ENHANCEMENT SYSTEMS OR DEVICES, DIRECTIONAL SPEAKER FOR ELECTRONIC DEVICE, PERSONALIZED AUDIO SYSTEMS OR DEVICES, AND METHODS THEREFOR," which is hereby incorporated herein by reference; and (iii) U.S. Provisional Patent Application No. 60/493,441, filed Aug. 8, 2003, and entitled "WIRELESS COMMUNICATION SYSTEMS OR DEVICES, HEARING ENHANCEMENT SYSTEMS OR DEVICES, DIRECTIONAL SPEAKER FOR ELECTRONIC DEVICE, AUDIO SYSTEMS OR DEVICES, WIRELESS AUDIO DELIVERY, AND METHODS THEREFOR," which is hereby incorporated herein by reference.

This application is also related to: (i) U.S. patent application Ser. No. 10/826,527, filed Apr. 15, 2004, now U.S. Pat. No. 7,388,962, entitled, "DIRECTIONAL HEARING ENHANCEMENT SYSTEMS," which is hereby incorporated herein by reference; (ii) U.S. patent application Ser. No. 10/826,531, filed Apr. 15, 2004, now U.S. Pat. No. 7,801,570, and entitled, "DIRECTIONAL SPEAKER FOR PORTABLE ELECTRONIC DEVICE," which is hereby incorporated herein by reference; (iii) U.S. patent application Ser. No. 10/826,537 filed Apr. 15, 2004, and entitled, "METHOD AND APPARATUS FOR LOCALIZED DELIVERY OF AUDIO SOUND FOR ENHANCED PRIVACY," which is hereby incorporated herein by reference; and (iv) U.S. patent application Ser. No. 10/826,528, filed Apr. 15, 2004, and entitled, "METHOD AND APPARATUS FOR WIRELESS AUDIO DELIVERY," which is hereby incorporated herein by reference.

BACKGROUND OF THE INVENTION

Description of the Related Art

Cell phones and other wireless communication systems have become an integral part of our lives. During the early $20^{th}$ Century, some predicted that if phone companies continued with their growth rate, everyone would become a phone operator. From a certain perspective, this prediction has actually come true. Cell phones have become so prevalent that many of us practically cannot live without them. As such, we might have become cell phone operators.

However, the proliferation of cell phones has brought on its share of headaches. The number of traffic accidents has increased due to the use of cell phones while driving. The increase is probably due to drivers taking their hands off the steering wheel to engage in phone calls. Instead of holding onto the steering wheel with both hands, one of the driver's hands may be holding a cell phone. Or, even worse, one hand may be holding a phone and the other dialing it. The steering wheel is left either unattended, or, at best, maneuvered by the driver's thighs!

Another disadvantage of cell phones is that they might cause brain tumors. With a cell phone being used so close to one's brain, there are rumors that the chance of getting a brain tumor is increased. One way to reduce the potential risk is to use an earpiece or headset connected to the cell phone.

Earpieces and headsets, however, can be quite inconvenient. Imagine your cell phone rings. You pick up the call but then you have to tell the caller to hold while you unwrap and extend the headset wires, plug the headset to the cell phone, and then put on the headset. This process is inconvenient to both the caller, who has to wait, and to you, as you fumble around to coordinate the use of the headset. Also, many headsets require earpieces. Having something plugged into one's ear is not natural and is annoying to many, especially for long phone calls. Further, if you are jogging or involved in a physical activity, the headset can get dislodged or detached.

It should be apparent from the foregoing that there is still a need for improved ways to enable wireless communication systems to be used hands-free.

SUMMARY

A number of embodiments of the present invention provide a wireless communication system that has a directional speaker. In one embodiment, with the speaker appropriately attached or integral to a user's clothing, the user can receive audio signals from the speaker hands-free. The audio-signals from the speaker are directional, allowing the user to hear the audio signals without requiring an earpiece, while providing certain degree of privacy protection.

The wireless communication system can be a phone. In one embodiment, the system has a base unit coupled to an interface unit. The interface unit includes a directional speaker and a microphone. Audio signals are generated by transforming directional ultrasonic signals (output by the directional speaker) with air. In one embodiment, the interface unit can be attached to the shoulder of the user, and the audio signals from the speaker can be directed towards one of the user's ears.

The interface unit can be coupled to the base unit through a wired or wireless connection. The base unit can also be attached to the clothing of the user.

The phone, particularly a cell phone, can be a dual-mode phone. One mode is the hands-free mode phone. The other mode is the normal mode, where the audio signals are generated directly from the speaker.

The interface unit can include two speakers, each located on, or proximate to, a different shoulder of the user. The microphone can also be separate from, and not integrated to, the speaker.

In one embodiment, the speaker can be made of one or more devices that can be piezoelectric thin-film devices, bimorph devices or magnetic transducers. Multiple devices can be arranged to form a blazed grating, with the orthogonal direction of the grating pointed towards the ear. Multiple devices can also be used to form a phase array, which can generate an audio beam that has higher directivity and is steerable.

In another embodiment, the wireless communication system can be used as a hearing aid. The system can also be both a cell phone and a hearing aid, depending on whether there is an incoming call.

In still another embodiment, the interface unit does not have a microphone, and the wireless communication system can be used as an audio unit, such as a CD player. The interface unit can also be applicable for playing video games, watching television or listening to a stereo system. Due to the directional audio signals, the chance of disturbing people in the immediate neighborhood is significantly reduced.

In yet another embodiment, the interface unit is integrated with the base unit. The resulting wireless communication system can be attached to the clothing of the user, with its audio signals directed towards one ear of the user.

In another embodiment, the base unit includes the capability to serve as a computation system, such as a personal digital assistant (PDA) or a portable computer. This allows the user to simultaneously use the computation system (e.g. PDA) as well as making phone calls. The user does not have to use his hand to hold a phone, thus freeing both hands to interact with the computation system. In another approach for this embodiment, the directional speaker is not attached to the clothing of the user, but is integrated to the base unit. The base unit can also be enabled to be connected wirelessly to a local area network, such as to a WiFi or WLAN network, which allows high-speed data as well as voice communication with the network.

In still another embodiment, the wireless communication system is personalized to the hearing characteristics of the user, or is personalized to the ambient noise level in the vicinity of the user.

In one embodiment, a first portion of audio input signals can be pre-processed, with the output used to modulate ultrasonic carrier signals, thereby producing modulated ultrasonic signals. The modulated ultrasonic signals can be transformed into a first portion of audio output signals, which is directional. Based on a second portion of the audio input signals, a standard audio speaker can output a second portion of the audio output signals. Another embodiment further produces distortion compensated signals based on the pre-processed signals. The distortion compensated signals can be subtracted from the second portion of the audio input signals to generate inputs for the standard audio speaker to output the second portion of the audio output signals.

One embodiment includes a speaker arrangement for an audio output apparatus including a filter, a pre-processor, a modulator, an ultrasonic speaker (generating audio signals with the need for non-linear transformation of ultrasonic signals) and a standard speaker (generating audio signals without the need for non-linear transformation of ultrasonic signals). The filter can be configured to separate audio input signals into low frequency signals and high frequency signals. The pre-processor can be operatively connected to receive the high frequency signals from the filter and to perform predetermined preprocessing on the high frequency signals to produce pre-processed signals. The modulator can be operatively connected to the pre-processor to modulate ultrasonic carrier signals by the pre-processed signals thereby producing modulated ultrasonic signals. The ultrasonic speaker can be operatively connected to the modulator to receive the modulated ultrasonic signals and to output ultrasonic output signals which are transformed into high frequency audio output signals. The standard audio speaker can be operatively connected to the filter to receive the low frequency signals and to output low frequency audio output signals. In one embodiment, the speaker arrangement further includes a distortion compensation unit and a combiner. The distortion compensation unit can be operatively connected to the pre-processor to produce distortion compensated signals. The combiner can be operatively connected to the filter to subtract the distortion compensated signals from the low frequency signals to produce inputs for the standard speaker. Another embodiment does not include the filter. Yet another embodiment, noise can be added to the pre-processed signals.

Other aspects and advantages of the present invention will become apparent from the following detailed description, which, when taken in conjunction with the accompanying drawings, illustrates by way of example the principles of the invention.

Same numerals in FIGS. 1-23 are assigned to similar elements in all the figures. Embodiments of the invention are discussed below with reference to FIGS. 1-23. However, those skilled in the art will readily appreciate that the detailed description given herein with respect to these figures is for explanatory purposes as the invention extends beyond these limited embodiments.

DETAILED DESCRIPTION OF THE INVENTION

Figure 1:
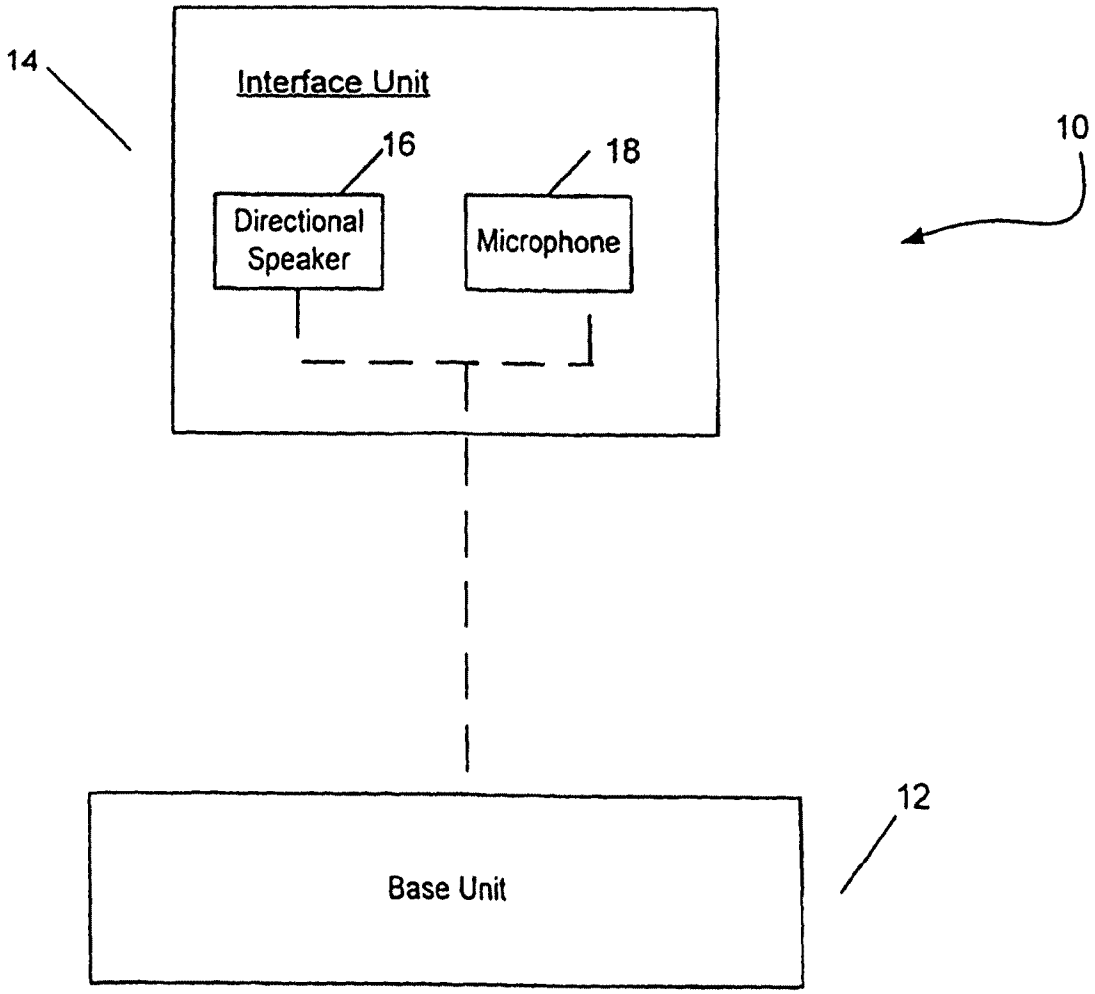
FIG. 1 shows one embodiment of the invention with a base unit coupled to a directional speaker and a microphone.

One embodiment of the present invention is a wireless communication system that provides improved hands-free usage. The wireless communication system can, for example, be a mobile phone. FIG. 1 shows a block diagram of wireless communication system 10 according to one embodiment of the invention. The wireless communication system 10 has a base unit 12 that is coupled to an interface unit 14. The interface unit 14 includes a directional speaker 16 and a microphone 18. The directional speaker 16 generates directional audio signals.

From basic aperture antenna theory, the angular beam width $\theta$ of a source, such as the directional speaker, is roughly $\lambda/D$, where $\theta$ is the angular full width at half-maximum (FWHM), $\lambda$ is the wavelength and D is the diameter of the aperture. For simplicity, assume the aperture to be circular.

For ordinary audible signals, the frequency is from a few hundred hertz, such as 500 Hz, to a few thousand hertz, such as 5000 Hz. With the speed of sound in air c being 340 m/s, $\lambda$ of ordinary audible signals is roughly between 70 cm and 7 cm. For personal or portable applications, the dimension of a speaker can be in the order of a few cm. Given that the acoustic wavelength is much larger than a few cm, such a speaker is almost omni-directional. That is, the sound source is emitting energy almost uniformly at all directions. This can be undesirable if one needs privacy because an omni-directional sound source means that anyone in any direction can pickup the audio signals.

To increase the directivity of the sound source, one approach is to decrease the wavelength of sound, but this can put the sound frequency out of the audible range. Another technique is known as parametric acoustics.

Parametric acoustic operation has previously been discussed, for example, in the following publications: "Parametric Acoustic Array," by P. J. Westervelt, in J., Acoust. Soc. Am., Vol. 35 (4), pp. 535-537, 1963; "Possible exploitation of Non-Linear Acoustics in Underwater Transmitting Applications," by H. O. Berktay, in J. Sound Vib. Vol. 2 (4): 435-461 (1965); and "Parametric Array in Air," by Bennett et al., in J. Acoust. Soc. Am., Vol. 57 (3), pp. 562-568, 1975.

In one embodiment, assume that the audible acoustic signal is f(t) where f(t) is a band-limited signal, such as from 500 to 5,000 Hz. A modulated signal f(t) sin $\omega_c$ t is created to drive an acoustic transducer. The carrier frequency $\omega_c/2\pi$ should be much larger than the highest frequency component of f(t). In an example, the carrier wave is an ultrasonic wave. The acoustic transducer should have a sufficiently wide bandwidth at $\omega_c$ to cover the frequency band of the incoming signal f(t). After this signal f(t) sin $\omega_c$ t is emitted from the transducer, non-linear demodulation occurs in air, creating an audible signal, E(t), where $$E(t) \propto \partial^2/\partial t^2[f^2(\tau)]$$

with $\tau = t - L/c$, and L being the distance between the source and the receiving ear. In this example, the demodulated audio signal is proportional to the second time derivative of the square of the modulating envelope f(t).

To retrieve the audio signal f(t) more accurately, a number of approaches pre-process the original audio signals before feeding them into the transducer. Each has its specific attributes and advantages. One pre-processing approach is disclosed in "Acoustic Self-demodulation of Pre-distorted Carriers," by B. A. Davy, Master's Thesis submitted to U. T. Austin in 1972. The disclosed technique integrates the signal f(t) twice, and then square-roots the result before multiplying it with the carrier sin $\omega_c$ t. The resultant signals are applied to the transducer. In doing so, an infinite harmonics of f(t) could be generated, and a finite transmission bandwidth can create distortion.

Another pre-processing approach is described in "The audio spotlight: An application of nonlinear interaction of sound waves to a new type of loudspeaker design," by Yoneyama et al., Journal of the Acoustic Society of America, Vol. 73 (5), pp. 1532-1536, May 1983. The pre-processing scheme depends on double side-band (DSB) modulation. Let S(t)=1+m f(t), where m is the modulation index. S(t) sin $\omega_c$ t is used to drive the acoustic transducer instead of f(t) sin $\omega_c$ t. Thus, $$E(t) \propto \partial^2/\partial t^2[S^2(\tau)] \propto 2mf(\tau)+m^2\partial^2/\partial t^2[f(\tau)^2].$$

The first term provides the original audio signal. But the second term can produce undesirable distortions as a result of the DSB modulation. One way to reduce the distortions is by lowering the modulation index m. However, lowering m may also reduce the overall power efficiency of the system.

In "Development of a parametric loudspeaker for practical use," Proceedings of $10^{th}$ International Symposium on Non-linear Acoustics, pp. 147-150, 1984, Kamakura et al. introduced a pre-processing approach to remove the undesirable terms. It uses a modified amplitude modulation (MAM) technique by defining $S(t)=[1+m\ f(t)]^{1/2}$. That is, the demodulated signal $E(t) \propto m\ f(t)$. The square-rooted envelope operation of the MAM signal can broaden the bandwidth of S(t), and can require an infinite transmission bandwidth for distortion-free demodulation.

In "Suitable Modulation of the Carrier Ultrasound for a Parametric Loudspeaker," Acoustica, Vol. 23, pp. 215-217, 1991, Kamakura et al. introduced another pre-processing scheme, known as "envelope modulation". In this scheme, $S(t)=[e(t)+m\ f(t)]^{1/2}$ where e(t) is the envelope of f(t). The transmitted power was reduced by over 64% using this scheme and the distortion was better than the DSB or single-side band (SSB) modulation, as described in "Self-demodulation of a plane-wave—Study on primary wave modulation for wideband signal transmission," by Aoki et al., J. Acoust. Soc. Jpn., Vol. 40, pp. 346-349, 1984.

Back to directivity, the modulated signals, S(t) sin $\omega_c$ t or f(t) sin $\omega_c$ t, have a better directivity than the original acoustic signal f(t), because $\omega_c$ is higher than the audible frequencies. As an example, $\omega_c$ can be $2\pi$*40 kHz, though experiment has shown that $\omega_c$ can range from $2\pi$*20 kHz to well over $2\pi$*1 MHz. Typically, $\omega_c$ is chosen not to be too high because of the higher acoustic absorption at higher carrier frequencies. Anyway, with $\omega_c$ being $2\pi$*40 kHz, the modulated signals have frequencies that are approximately ten times higher than the audible frequencies. This makes an emitting source with a small aperture, such as 2.5 cm in diameter, a directional device for a wide range of audio signals.

In one embodiment, choosing a proper working carrier frequency $\omega_c$ takes into consideration a number of factors, such as:

1. To reduce the acoustic attenuation, which is generally proportional to $\omega_c^2$, the carrier frequency $\omega_c$ should not be high.
2. The FWHM of the ultrasonic beam should be large enough, such as 25 degrees, to accommodate head motions of the person wearing the portable device and to reduce the ultrasonic intensity through beam expansion.
3. To avoid the near-field effect which may cause amplitude fluctuations, the distance between the emitting device and the receiving ear r should be greater than $0.3*R_0$, where $R_0$ is the Rayleigh distance, and is defined as (the area of the emitting aperture/λ).

As an example, with FWHM being 20 degrees, $$\theta=\lambda/D=(c2\pi/(\omega_c)/D\sim 1/3.$$

Assuming D is 2.5 cm, $\omega_c$ becomes 2η*40 kHz. From this relation, it can be seen that the directivity of the ultrasonic beam can be adjusted by changing the carrier frequency $\omega_c$. If a smaller aperture acoustic transducer is preferred, the directivity may decrease. Note also that the power generated by the acoustic transducer is typically proportional to the aperture area. In the above example, the Rayleigh distance $R_0$ is about 57 mm.

Based on the above description, in one embodiment, directional audio signals can be generated by the speaker 16 even with a relatively small aperture through modulated ultrasonic signals. The modulated signals can be demodulated in air to regenerate the audio signals. The speaker 16 can then generate directional audio signals even when emitted from an aperture that is in the order of a few centimeters. This allows the directional audio signals to be pointed at desired directions.

Note that a number of examples have been described on generating audio signals through demodulating ultrasonic signals. However, the audio signals can also be generated through mixing two ultrasonic signals whose difference frequencies are the audio signals.

Figure 2:
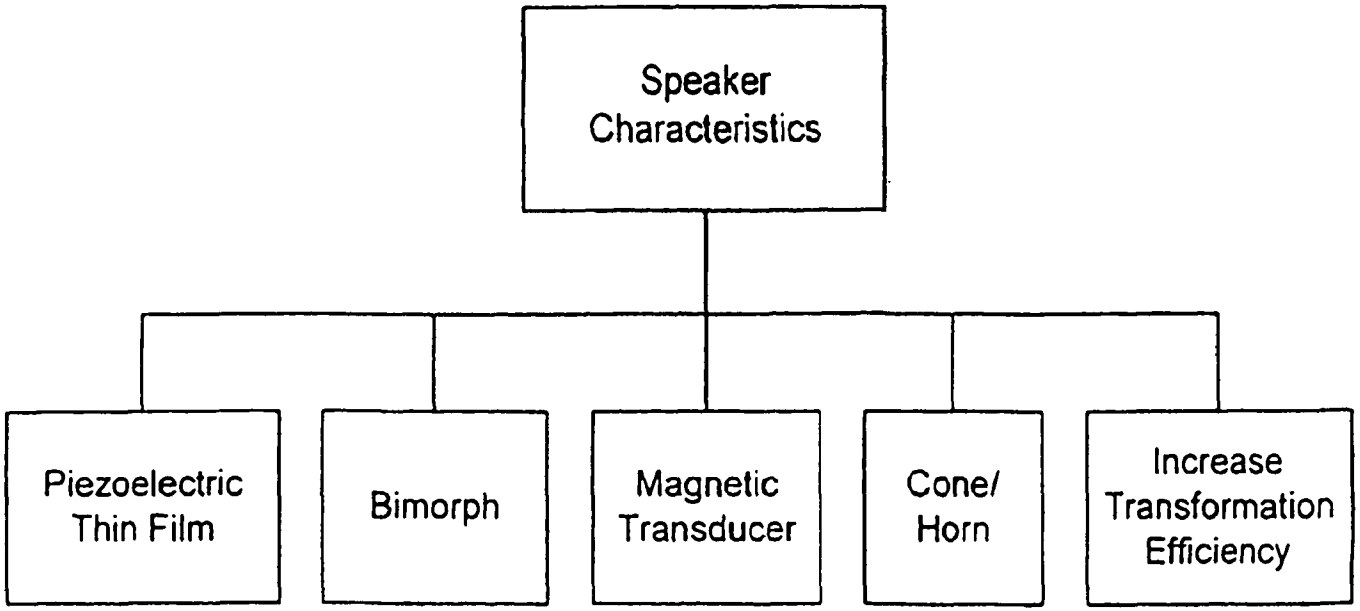
FIG. 2 shows examples of characteristics of a directional speaker of the present invention.

FIG. 2 shows examples of characteristics of a directional speaker. The directional speaker can, for example, be the directional speaker 16 illustrated in FIG. 1. The directional speaker can use a piezoelectric thin film. The piezoelectric thin film can be deposited on a plate with many cylindrical tubes. An example of such a device is described in U.S. Pat. No. 6,011,855, which is hereby incorporated by reference. The film can be a polyvinylidiene di-fluoride (PVDF) film, and can be biased by metal electrodes. The film can be attached or glued to the perimeter of the plate of tubes. The total emitting surfaces of all of the tubes can have a dimension in the order of a few wavelengths of the carrier or ultrasonic signals. Appropriate voltages applied through the electrodes to the piezoelectric thin film create vibrations of the thin film to generate the modulated ultrasonic signals. These signals cause resonance of the enclosed tubes. After emitted from the film, the ultrasonic signals self-demodulate through non-linear mixing in air to produce the audio signals.

As one example, the piezoelectric film can be about 28 microns in thickness; and the tubes can be 9/64" in diameter and spaced apart by 0.16", from center to center of the tube, to create a resonating frequency of around 40 kHz. With the ultrasonic signals being centered around 40 kHz, the emitting surface of the directional speaker can be around 2 cm by 2 cm. A significant percentage of the ultrasonic power generated by the directional speaker can, in effect, be confined in a cone.

To calculate the amount of power within the cone, for example, as a rough estimation, assume that (a) the emitting surface is a uniform circular aperture with the diameter of 2.8 cm, (b) the wavelength of the ultrasonic signals is 8.7 mm, and (c) all power goes to the forward hemisphere, then the ultrasonic power contained within the FWHM of the main lobe is about 97%, and the power contained from null to null of the main lobe is about 97.36%. Similarly, again as a rough estimation, if the diameter of the aperture drops to 1 cm, the power contained within the FWHM of the main lobe is about 97.2%, and the power contained from null to null of the main lobe is about 99%.

Referring back to the example of the piezoelectric film, the FWHM of the signal beam is about 24 degrees. Assume that such a directional speaker 16 is placed on the shoulder of a user. The output from the speaker can be directed in the direction of one of the ears of the user, with the distance between the shoulder and the ear being, for example, 8 inches. More than 75% of the power of the audio signals generated by the emitting surface of the directional speaker can, in effect, be confined in a cone. The tip of the cone is at the speaker, and the mouth of the cone is at the location of the user's ear. The diameter of the mouth of the cone, or the diameter of the cone in the vicinity of the ear, is less than about 4 inches.

In another embodiment, the directional speaker can be made of a bimorph piezoelectric transducer. The transducer can have a cone of about 1 cm in diameter. In yet another embodiment, the directional speaker can be a magnetic transducer. In a further embodiment, the directional speaker does not generate ultrasonic signals, but generates audio signals directly; and the speaker includes, for example, a physical horn or cone to direct the audio signals.

In yet another embodiment, the power output from the directional speaker is increased by increasing the transformation efficiency (e.g., demodulation or mixing efficiency) of the ultrasonic signals. According to the Berktay's formula, as disclosed, for example, in "Possible exploitation of Non-Linear Acoustics in Underwater Transmitting Applications," by H. O. Berktay, in J. Sound Vib. Vol. 2 (4):435-461 (1965), which is hereby incorporated by reference, output audio power is proportional to the coefficient of non-linearity of the mixing or demodulation medium. One approach to increase the efficiency is to have at least a portion of the transformation performed in a medium other than air.

Figure 3:
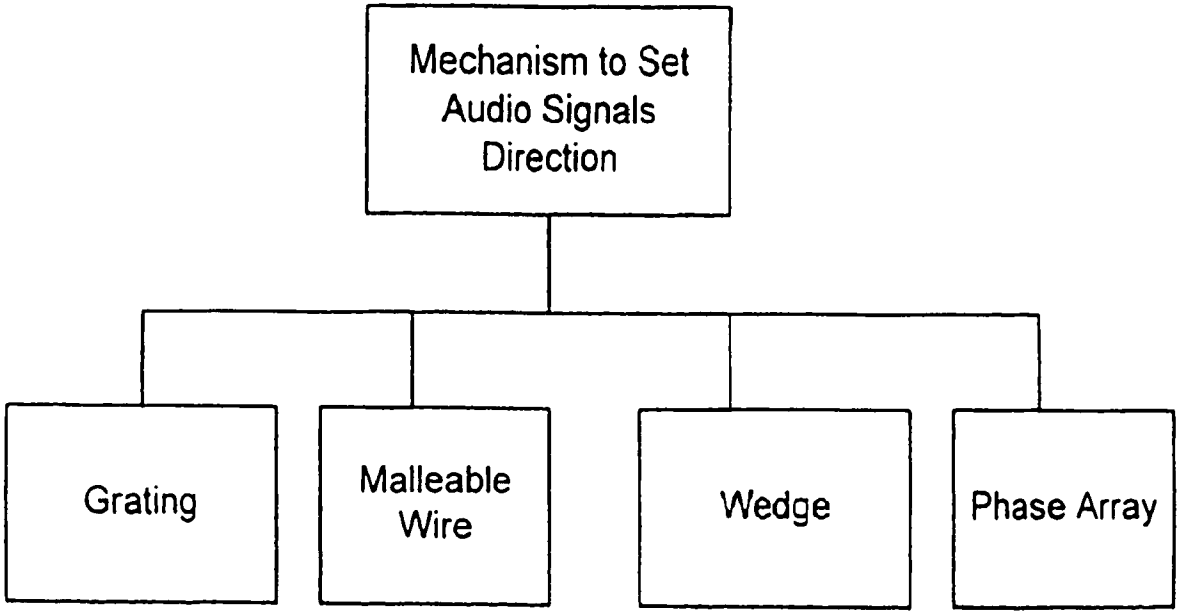
FIG. 3 shows examples of mechanisms to set the direction of audio signals of the present invention.

As explained, in one embodiment, based on parametric acoustic techniques, directional audio signals can be generated. FIG. 3 shows examples of mechanisms to direct the ultrasonic signals. They represent different approaches, which can utilize, for example, a grating, a malleable wire, or a wedge.

Figure 4A:
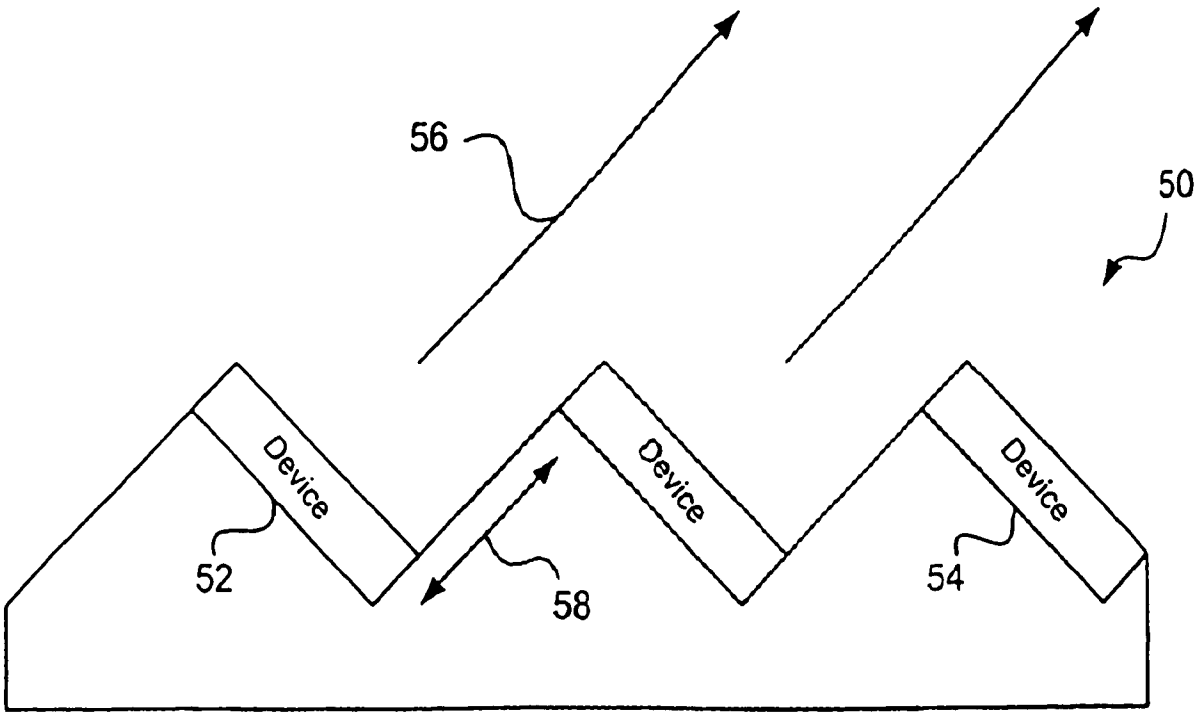
FIG. 4A shows one embodiment of a blazed grating for the present invention.

FIG. 4A shows one embodiment of a directional speaker 50 having a blazed grating. The speaker 50 is, for example, suitable for use as the directional speaker 16. Each emitting device, such as 52 and 54, of the speaker 50 can be a piezoelectric device or another type of speaker device located on a step of the grating. In one embodiment, the sum of all of the emitting surfaces of the emitting devices can have a dimension in the order of a few wavelengths of the ultrasonic signals.

In another embodiment, each of the emitting devices can be driven by a replica of the ultrasonic signals with an appropriate delay to cause constructive interference of the emitted waves at the blazing normal 56, which is the direction orthogonal to grating. This is similar to the beam steering operation of a phase array, and can be implemented by a delay matrix. The delay between adjacent emitting surfaces can be approximately h/c, with the height of each step being h. One approach to simplify signal processing is to arrange the height of each grating step to be an integral multiple of the ultrasonic or carrier wavelength, and all the emitting devices can be driven by the same ultrasonic signals.

Based on the grating structure, the array direction of the virtual audio sources can be the blazing normal 56. In other words, the structure of the steps can set the propagation direction of the audio signals. In the example shown in FIG. 4A, there are three emitting devices or speaker devices, one on each step. The total emitting surfaces are the sum of the emitting surfaces of the three devices. The propagation direction is approximately 45 degrees from the horizontal plane. The thickness of each speaker device can be less than half the wavelength of the ultrasonic waves. If the frequency of the ultrasonic waves is 40 kHz, the thickness can be about 4 mm.

Another approach to direct the audio signals to specific directions is to position a directional speaker of the present invention at the end of a malleable wire. The user can bend the wire to adjust the direction of propagation of the audio signals. For example, if the speaker is placed on the shoulder of a user, the user can bend the wire such that the ultrasonic signals produced by the speaker are directed towards the ear adjacent to the shoulder of the user.

Figure 4B:
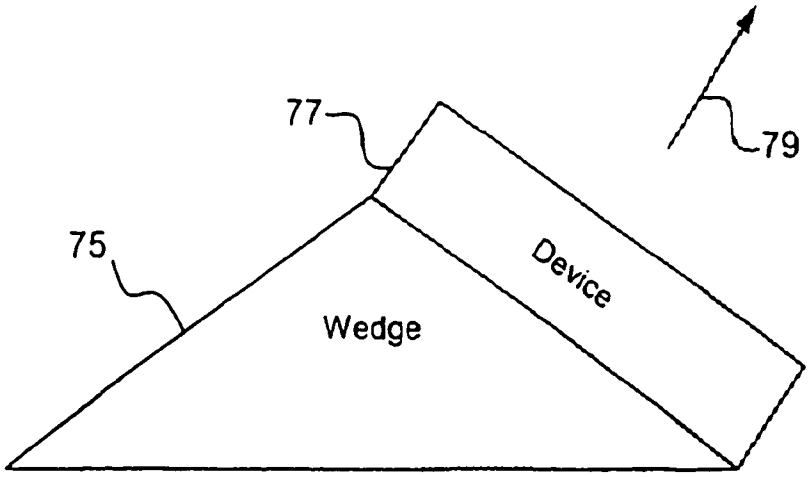
FIG. 4B shows an example of a wedge to direct the propagation angle of audio signals for the present invention.

Still another approach is to position the speaker device on a wedge. FIG. 4B shows an example of a wedge 75 with a speaker device 77. The angle of the wedge from the horizontal can be about 40 degrees. This sets the propagation direction 79 of the audio signals to be about 50 degrees from the horizon.

Figure 5:
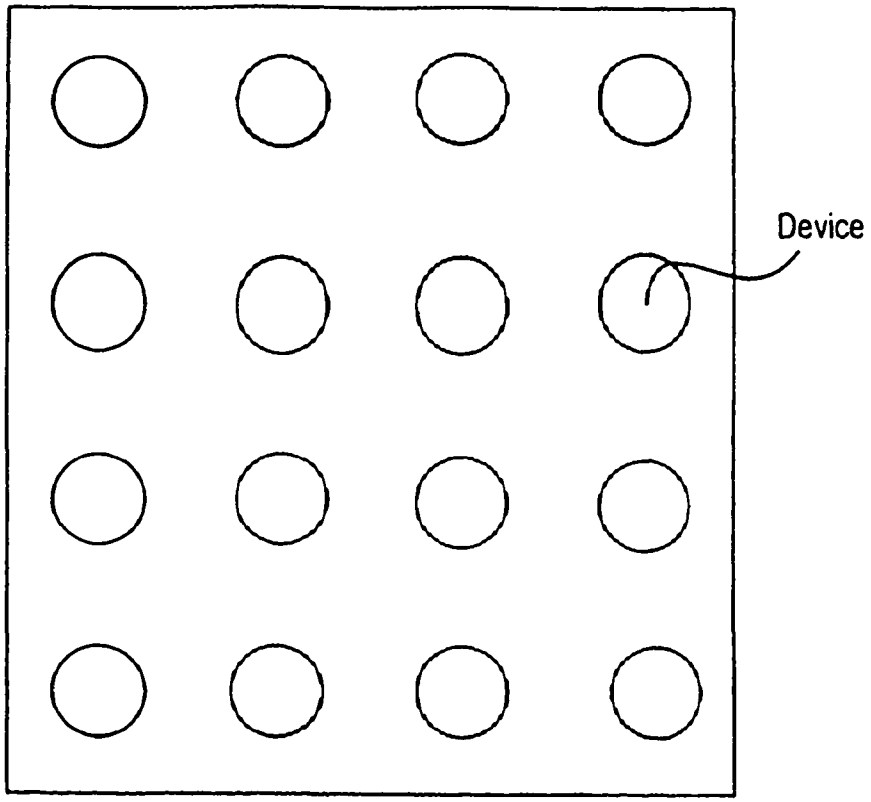
FIG. 5 shows an example of a steerable phase array of devices to generate the directional audio signals in accordance with the present invention.

In one embodiment, the ultrasonic signals are generated by a steerable phase array of individual devices, as illustrated, for example, in FIG. 5. They generate the directional signals by constructive interference of the devices. The signal beam is steerable by changing the relative phases among the array of devices.

One way to change the phases in one direction is to use a one-dimensional array of shift registers. Each register shifts or delays the ultrasonic signals by the same amount. This array can steer the beam by changing the clock frequency of the shift registers. These can be known as "x" shift registers. To steer the beam independently also in an orthogonal direction, one approach is to have a second set of shift registers controlled by a second variable rate clock. This second set of registers, known as "y" shift registers, is separated into a number of subsets of registers. Each subset can be an array of shift registers and each array is connected to one "x" shift register. The beam can be steered in the orthogonal direction by changing the frequency of the second variable rate clock.

For example, as shown in FIG. 5, the acoustic phase array is a 4 by 4 array of speaker devices. The devices in the acoustic phase array are the same. For example, each can be a bimorph device or transmitter of 7 mm in diameter. The overall size of the array can be around 2.8 cm by 2.8 cm. The carrier frequency can be set to 100 kHz. Each bimorph is driven at less than 0.1 W. The array is planar but each bimorph is pointed at the ear, such as at about 45 degrees to the array normal. The FWHM main lobe of each individual bimorph is about 0.5 radian.

There can be 4 "x" shift registers. Each "x" shift register can be connected to an array of 4 "y" shift registers to create a 4 by 4 array of shift registers. The clocks can be running at approximately 10 MHz (100 ns per shift). The ultrasonic signals can be transmitted in digital format and delayed by the shift registers at the specified amount.

Assuming the distance of the array from an ear is approximately 20 cm, the main lobe of each array device covers an area of roughly 10 cm×10 cm around the ear. As the head can move over an area of 10 cm×10 cm, the beam can be steerable roughly by a phase of 0.5 radian over each direction. This is equivalent to a maximum relative time delay of 40 us across one direction of the phase array, or 5 us of delay per device.

For a n by n array, the ultrasonic beam from each array element interferes with each other to produce a final beam that is 1/n narrower in beam width. In the above example, n is equal to 4, and the beam shape of the phase array is narrowed by a factor of 4 in each direction. That is, the FWHM is less than 8 degrees, covering an area of roughly 2.8 cm×2.8 cm around the ear.

With power focused into a smaller area, the power requirement is reduced by a factor of $1/n^2$, significantly improving power efficiency. In one embodiment, the above array can give the acoustic power of over 90 dB SPL.

Instead of using the bimorph devices, the above example can use an array of piezoelectric thin film devices.

In one embodiment, the interface unit can also include a pattern recognition device that identifies and locates the ear, or the ear canal. Then, if the ear or the canal can be identified, the beam is steered more accurately to the opening of the ear canal. Based on closed loop control, the propagation direction of the ultrasonic signals can be steered by the results of the pattern recognition approach.

One pattern recognition approach is based on thermal mapping to identify the entrance to the ear canal. Thermal mapping can be through infrared sensors. Another pattern recognition approach is based on a pulsed-infrared LED, and a reticon or CCD array for detection. The reticon or CCD array can have a broadband interference filter on top to filter light, which can be a piece of glass with coating.

Note that if the system cannot identify the location of the ear or the ear canal, the system can expand the cone, or decrease its directivity. For example, all array elements can emit the same ultrasonic signals, without delay, but with the frequency decreased.

Privacy is often a concern for users of cell phones. Unlike music or video players where users passively receive information or entertainment, with cell phones, there is a two-way communication. In most circumstances, cell phone users have gotten accustomed to people hearing what they have to say. At least, they can control or adjust their part of the communication. However, cell phone users typically do not want others to be aware of their entire dialogue. Hence, for many applications, at least the voice output portion of the cell phone should provide some level of privacy. With the directional speaker as discussed herein, the audio signals are directional, and thus the wireless communication system provides certain degree of privacy protection.

Figure 6:
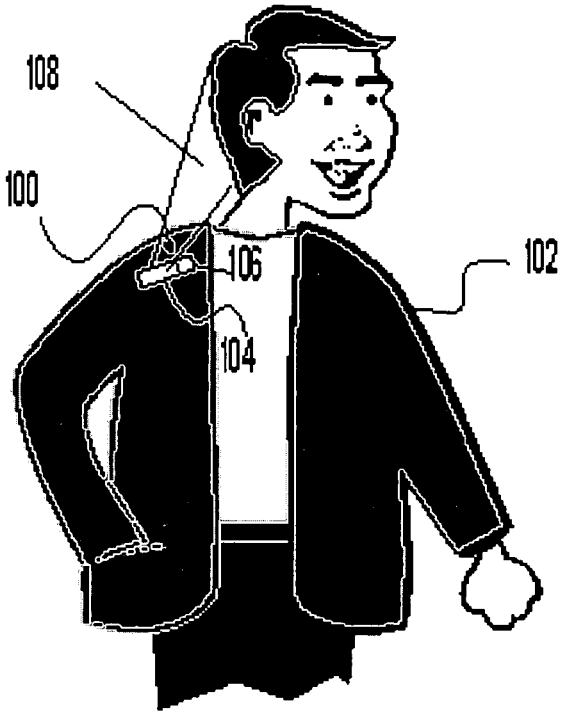
FIG. 6 shows one example of an interface unit attached to a piece of clothing of a user in accordance with the present invention.

FIG. 6 shows one example of the interface unit 100 attached to a jacket 102 of the user. The interface unit 100 includes a directional speaker 104 and a microphone 106. The directional speaker 104 emits ultrasonic signals in the general direction towards an ear of the user. The ultrasonic signals are transformed by mixing or demodulating in the air between the speaker and ear. The directional ultrasonic signals confine most of the audio energy within a cone 108 that is pointed towards the ear of the user. The surface area of the cone 108 when it reaches the head of the user can be tailored to be smaller than the head of the user. Hence, the directional ultrasonic signals are able to provide certain degree of privacy protection.

In one embodiment, there is one or more additional speaker devices provided within, proximate to, or around the directional speaker. The user's head can scatter a portion of the received audio signals. Others in the vicinity of the user may be able to pick up these scattered signals. The additional speaker devices, which can be piezoelectric devices, transmit random signals to interfere or corrupt the scattered signals or other signals that may be emitted outside the cone 108 of the directional signals to reduce the chance of others comprehending the scattered signals.

Figure 7:
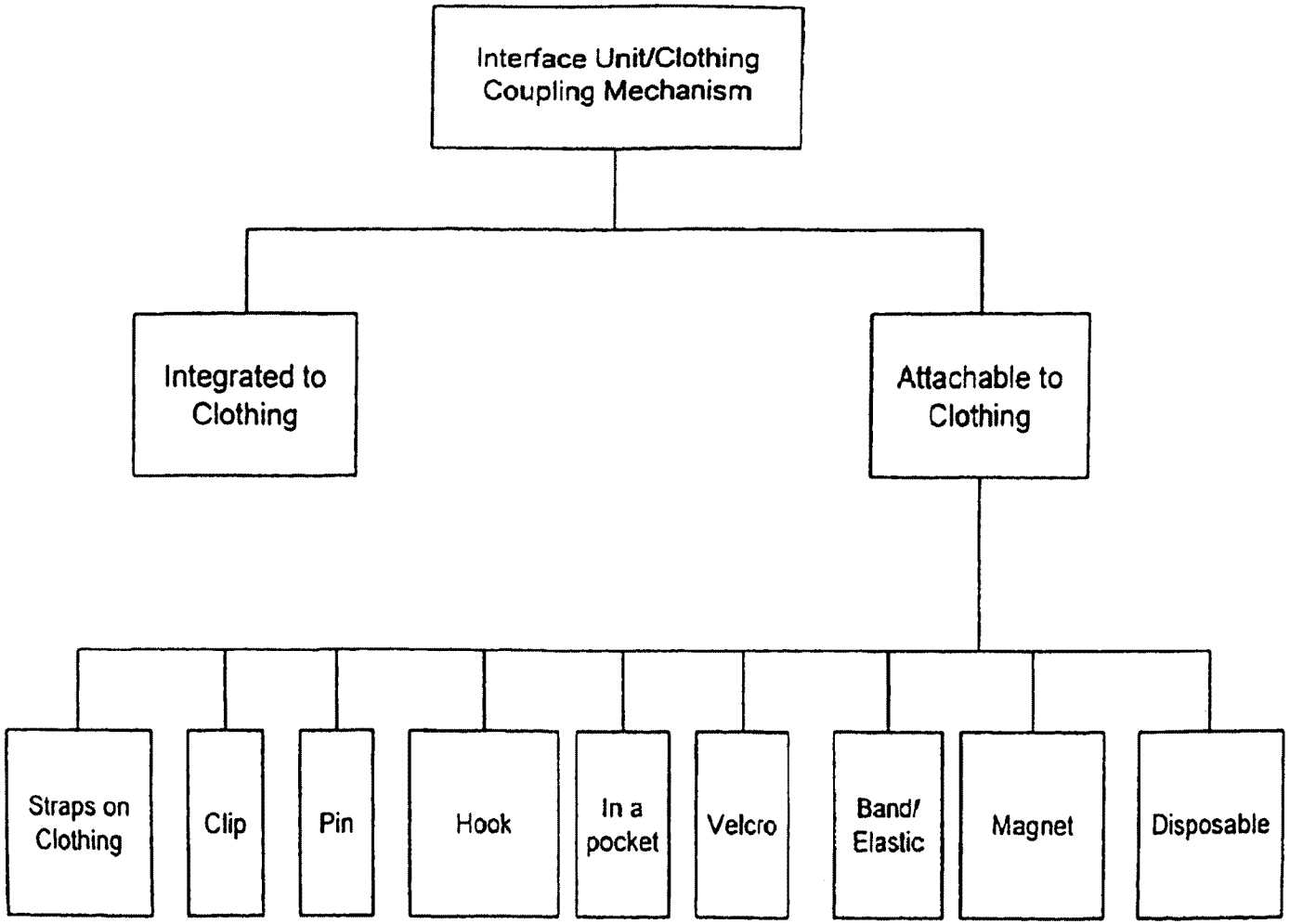
FIG. 7 shows examples of mechanisms to couple the interface unit to a piece of clothing in accordance with the present invention.

FIG. 7 shows examples of mechanisms to couple an interface unit to a piece of clothing. For example, the interface unit can be integrated into a user's clothing, such as located between the outer surface of the clothing and its inner lining. To receive power or other information from the outside, the interface unit can have an electrical protrusion from the inside of the clothing.

Instead of integrated into the clothing, in another embodiment, the interface unit can be attachable to the user's clothing. For example, a user can attach the interface unit to his clothing, and then turn it on. Once attached, the unit can be operated hands-free. The interface unit can be attached to a strap on the clothing, such as the shoulder strap of a jacket. The attachment can be through a clip, a pin or a hook. There can be a small pocket, such as at the collar bone area or the shoulder of the clothing, with a mechanism (e.g., a button) to close the opening of the pocket. The interface unit can be located in the pocket. In another example, a fastener can be on both the interface unit and the clothing for attachment purposes. In one example, the fastener can use hooks and loops (e.g., VELCRO brand fasteners). The interface unit can also be attached by a band, which can be elastic (e.g., an elastic armband). Or, the interface unit can be hanging from the neck of the user with a piece of string, like an ornamental design on a necklace. In yet another example, the interface unit can have a magnet, which can be magnetically attached to a magnet on the clothing. Note that one or more of these mechanisms can be combined to further secure the attachment. In yet another example, the interface unit can be disposable. For example, the interface unit could be disposed of once it runs out of power.

Figure 8:
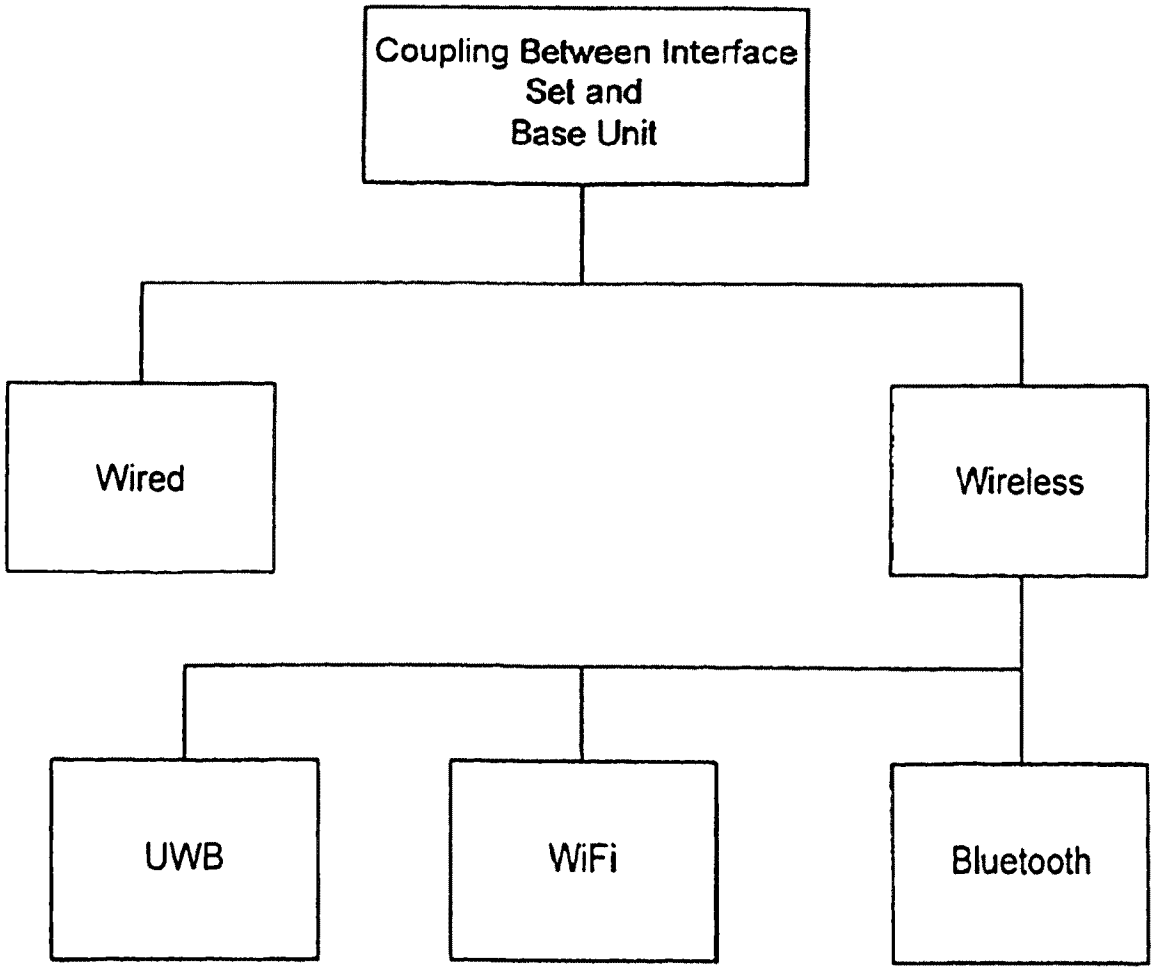
FIG. 8 shows examples of different coupling techniques between the interface unit and the base unit in the present invention.

Regarding the coupling between the interface unit and the base unit, FIG. 8 shows examples of a number of coupling techniques. The interface unit may be coupled wirelessly or tethered to the base unit through a wire. In the wireless embodiment, the interface unit may be coupled through Bluetooth, WiFi, Ultrawideband (UWB) or other wireless network/protocol.

Figure 9:
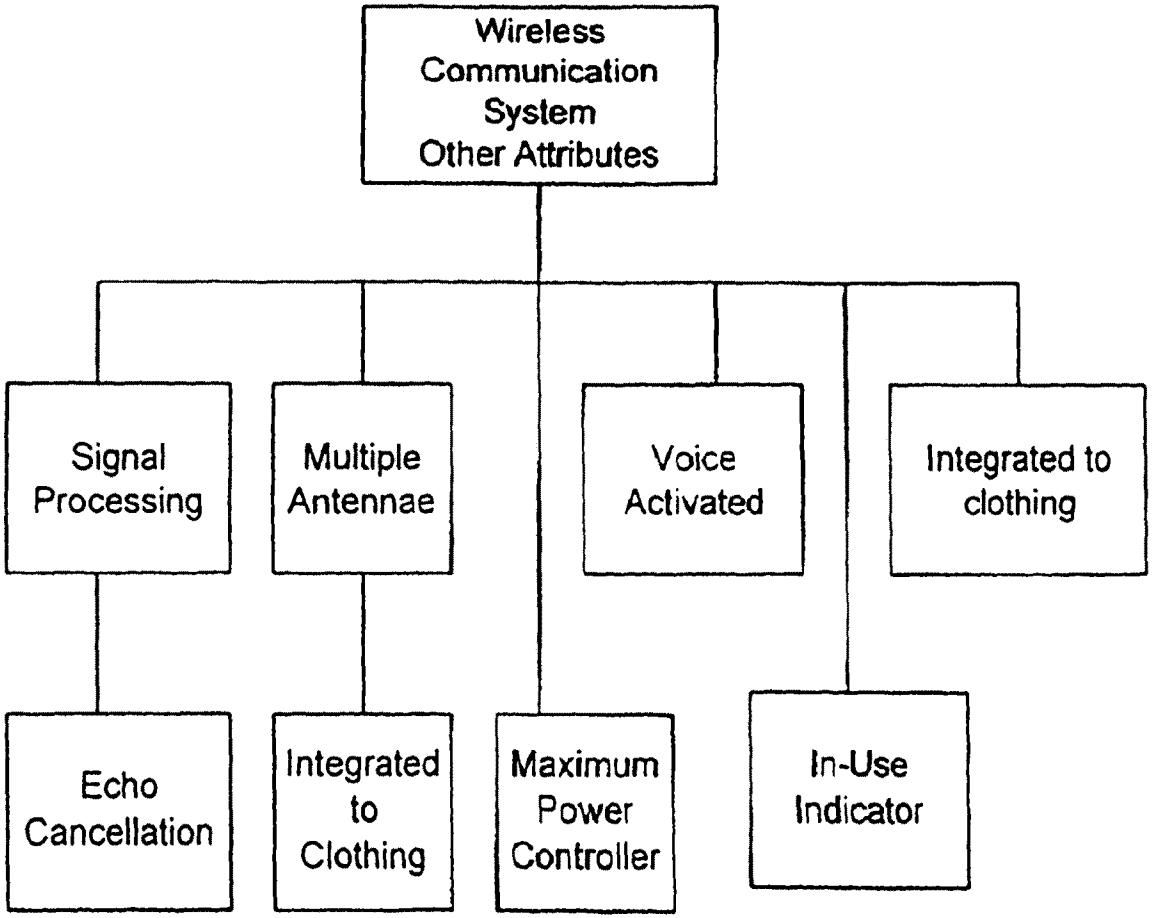
FIG. 9 shows examples of additional attributes of the wireless communication system in the present invention.

FIG. 9 shows examples of additional attributes of the wireless communication system of the present invention. The system can include additional signal processing techniques. Typically, single-side band (SSB) or lower-side band (LSB) modulation can be used with or without compensation for fidelity reproduction. If compensation is used, a processor (e.g., digital signal processor) can be deployed based on known techniques. Other components/functions can also be integrated with the processor. This can be local oscillation for down or up converting and impedance matching circuitry. Echo cancellation techniques may also be included in the circuitry. However, since the speaker is directional, the echo cancellation circuitry may not be necessary. These other functions can also be performed by software (e.g., firmware or microcode) executed by the processor.

The base unit can have one or more antennae to communicate with base stations or other wireless devices. Additional antennae can improve antenna efficiency. In the case where the interface unit wirelessly couples to the base unit, the antenna on the base unit can also be used to communicate with the interface unit. In this situation, the interface unit may also have more than one antenna.

The antenna can be integrated to the clothing. For example, the antenna and the base unit can both be integrated to the clothing. The antenna can be located at the back of the clothing.

The system can have a maximum power controller that controls the maximum amount of power delivered from the interface unit. For example, average output audio power can be set to be around 60 dB, and the maximum power controller limits the maximum output power to be below 70 dB. In one embodiment, this maximum power is in the interface unit and is adjustable.

The wireless communication system may be voice activated. For example, a user can enter, for example, phone numbers using voice commands. Information, such as phone numbers, can also be entered into a separate computer and then downloaded to the communication system. The user can then use voice commands to make connections to other phones.

The wireless communication system can have an in-use indicator. For example, if the system is in operation as a cell phone, a light source (e.g., a light-emitting diode) at the interface unit can operate as an in-use indicator. In one implementation, the light source can flash or blink to indicate that the system is in-use. The in-use indicator allows others to be aware that the user is, for example, on the phone.

In yet another embodiment, the base unit of the wireless communication system can also be integrated to the piece of clothing. The base unit can have a data port to exchange information and a power plug to receive power. Such port or ports can protrude from the clothing.

Figure 10:
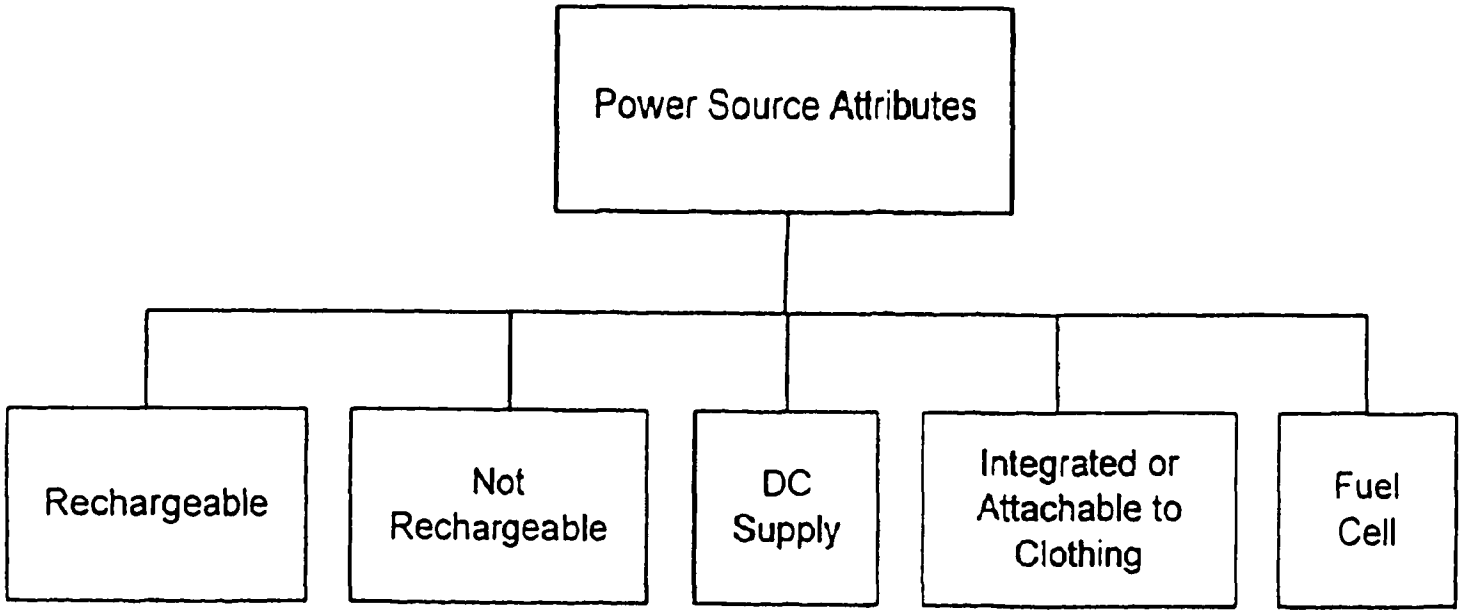
FIG. 10 shows examples of attributes of a power source for use with the present invention.

FIG. 10 shows examples of attributes of the power source. The power source may be a rechargeable battery or a non-rechargeable battery. As an example, a bimorph piezoelectric device, such as AT/R40-12P from Nicera, Nippon Ceramic Co., Ltd., can be used as a speaker device to form the speaker. It has a resistance of 1,000 ohms. Its power dissipation can be in the milliwatt range. A coin-type battery that can store a few hundred mAHours of energy has sufficient power to run the unit for a limited duration of time. Other types of batteries are also applicable.

The power source can be from a DC supply. The power source can be attachable, or integrated or embedded in a piece of clothing worn by the user. The power source can be a rechargeable battery. In one embodiment, for a rechargeable battery, it can be integrated in the piece of clothing, with its charging port exposed. The user can charge the battery on the road. For example, if the user is driving, the user can use a cigarette-lighter type charger to recharge the battery. In yet another embodiment, the power source is a fuel cell. The cell can be a cartridge of fuel, such methanol.

Figure 11A:
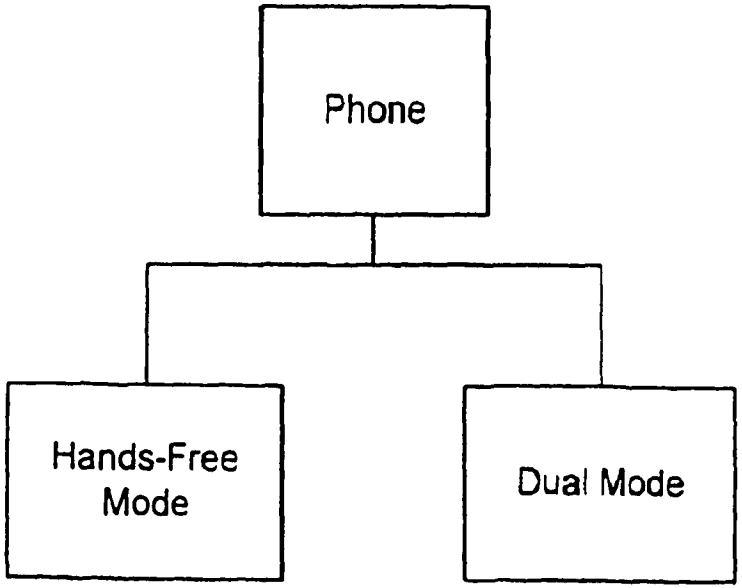
FIG. 11A shows the phone being a hands-free or a normal mode phone according to one embodiment of the present invention.

A number of embodiments have been described where the wireless communication system is a phone, particularly a cell phone that can be operated hands-free. In one embodiment, such can be considered a hands-free mode phone. FIG. 11A shows one embodiment where the phone can alternatively be a dual-mode phone. In a normal-mode phone, the audio signals are produced directly from a speaker integral with the phone (e.g., within its housing). Such a speaker is normally substantially non-directional (i.e., the speaker does not generate audio signals through transforming ultrasonic signals in air). In a dual mode phone, one mode is the hands-free mode phone as described above, and the other mode is the normal-mode phone.

Figure 11B:
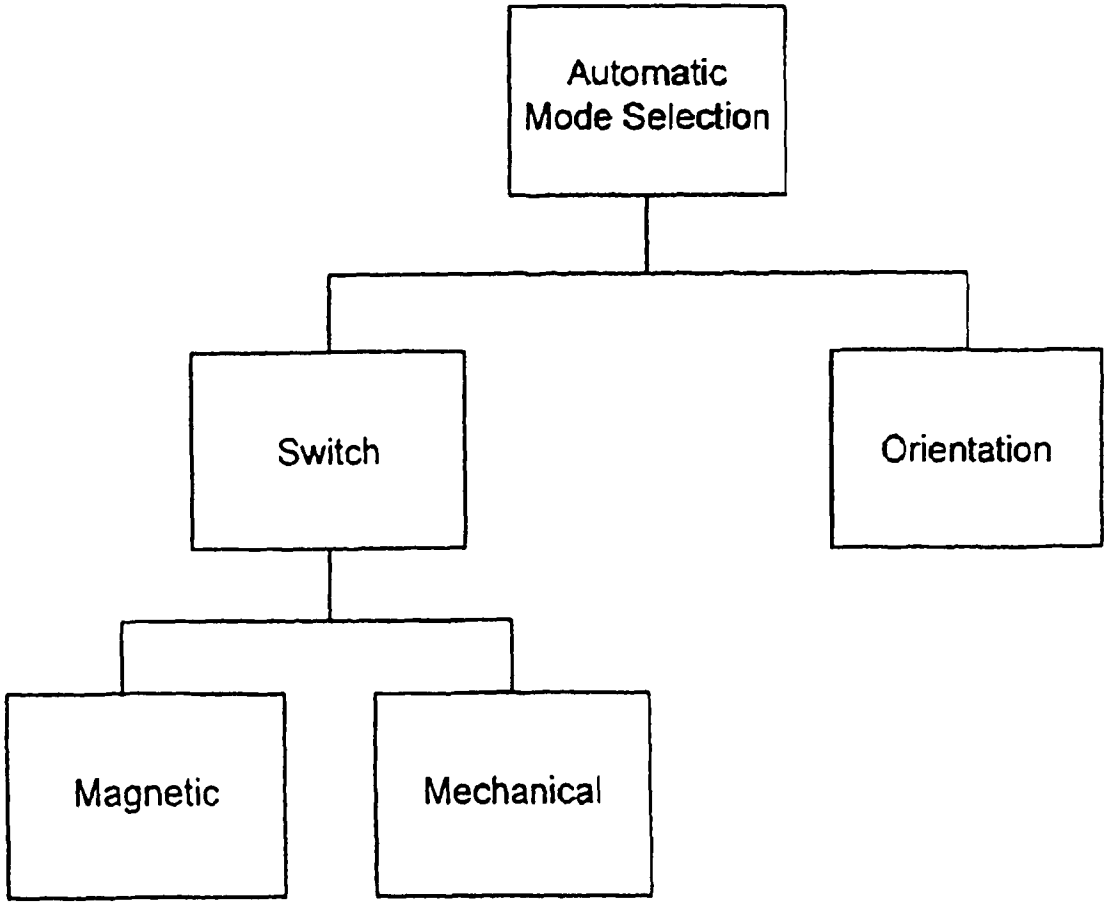
FIG. 11B shows examples of different techniques to automatically select the mode of a dual mode phone in accordance with the present invention.

The mode selection process can be set by a switch on the phone. In one embodiment, mode selection can be automatic. FIG. 11B shows examples of different techniques to automatically select the mode of a dual mode phone. For example, if the phone is attached to the clothing, the directional speaker of the interface unit can be automatically activated, and the phone becomes the hands-free mode phone. In one embodiment, automatic activation can be achieved through a switch integrated to the phone. The switch can be a magnetically-activated switch. For example, when the interface unit is attached to clothing (for hands-free usage), a magnet or a piece of magnetizable material in the clothing can cause the phone to operate in the hands-free mode. When the phone is detached from clothing, the magnetically-activated switch can cause the phone to operate as a normal-mode phone. In another example, the switch can be mechanical. For example, an on/off button on the unit can be mechanically activated if the unit is attached. This can be done, for example, by a lever such that when the unit is attached, the lever will be automatically pressed. In yet another example, activation can be based on orientation. If the interface unit is substantially in a horizontal orientation (e.g., within 30 degrees from the horizontal), the phone will operate in the hands-free mode. However, if the unit is substantially in a vertical orientation (e.g., within 45 degrees from the vertical), the phone will operate as a normal-mode phone. A gyro in the interface unit can be used to determine the orientation of the interface unit.

Figure 12:
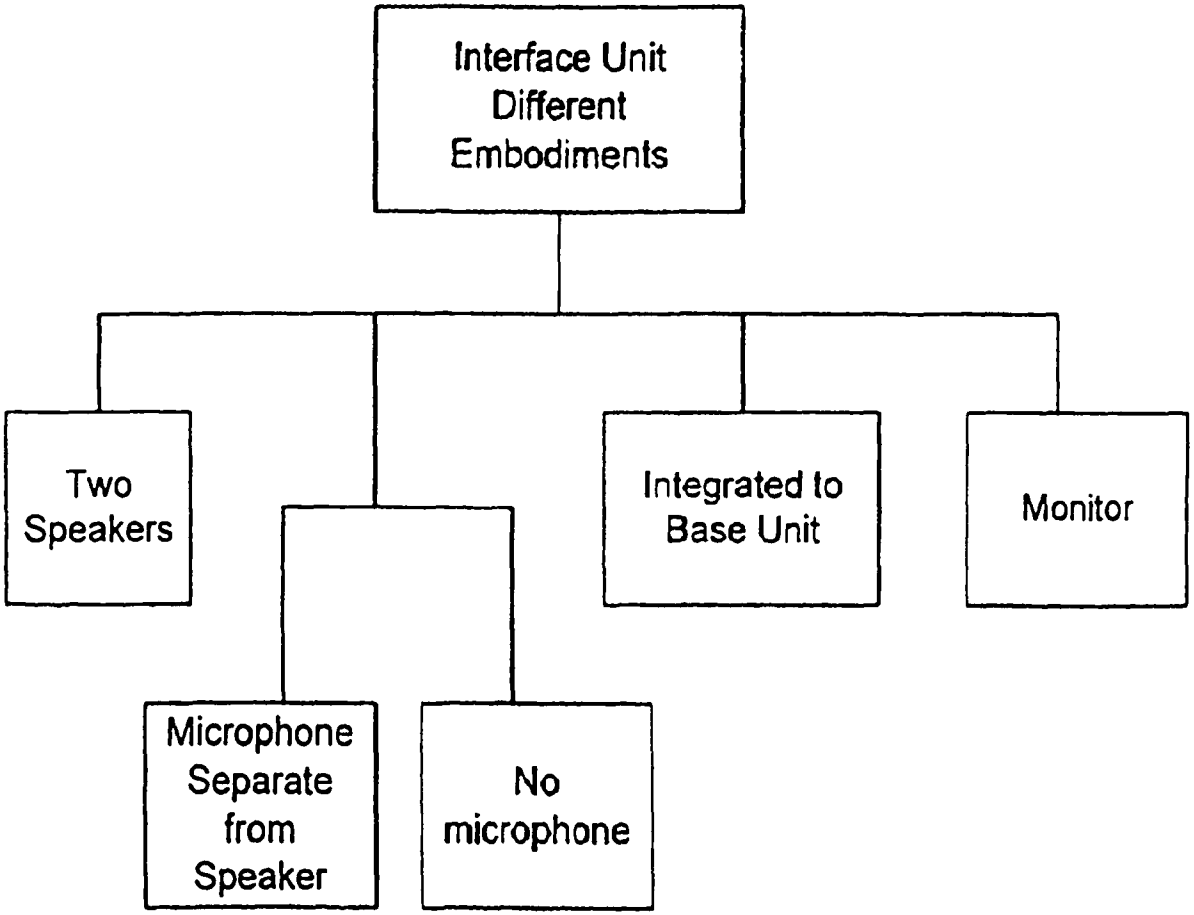
FIG. 12 shows examples of different embodiments of an interface unit of the present invention.
Figure 13:
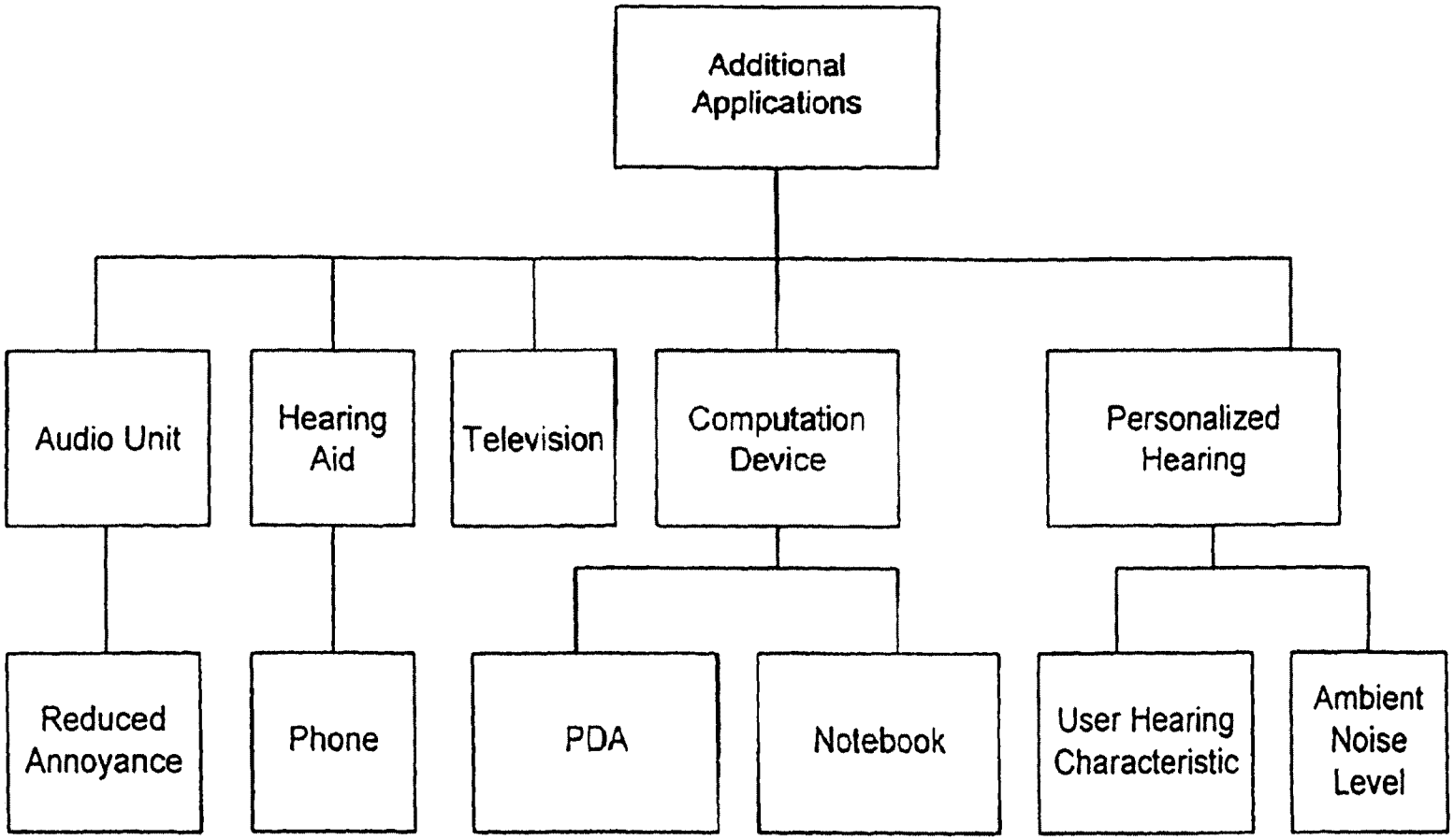
FIG. 13 shows examples of additional applications for the present invention.

A number of embodiments have been described where the wireless communication system is a phone with a directional speaker and a microphone. However, the present invention can be applied to other areas. FIG. 12 shows examples of other embodiments of the interface unit, and FIG. 13 shows examples of additional applications.

The interface unit can have two speakers, each propagating its directional audio signals towards one of the ears of the user. For example, one speaker can be on one shoulder of the user, and the other speaker on the other shoulder. The two speakers can provide a stereo effect for the user.

A number of embodiments have been described where the microphone and the speaker are integrated together in a single package. In another embodiment, the microphone can be a separate component and can be attached to the clothing as well. For wired connections, the wires from the base unit can connect to the speaker and at least one wire can split off and connect to the microphone at a location close to the head of the user.

The interface unit does not need to include a microphone. Such a wireless communication system can be used as an audio unit, such as a MP3 player, a CD player or a radio. Such wireless communication systems can be considered one-way communication systems.

In another embodiment, the interface unit can be used as the audio output, such as for a stereo system, television or a video game player. For example, the user can be playing a video game. Instead of having the audio signals transmitted by a normal speaker, the audio signals, or a representation of the audio signals, are transmitted wirelessly to a base unit or an interface unit. Then, the user can hear the audio signals in a directional manner, reducing the chance of annoying or disturbing people in his immediate environment.

In another embodiment, a wireless communication system can, for example, be used as a hearing aid. The microphone in the interface unit can capture audio signals in its vicinity, and the directional speaker can re-transmit the captured audio signals to the user. The microphone can also be a directional microphone that is more sensitive to audio signals in selective directions, such as in front of the user. In this application, the speaker output volume is typically higher. For example, one approach is to drive a bimorph device at higher voltages. The hearing aid can selectively amplify different audio frequencies by different amounts based on user preference or user hearing characteristics. In other words, the audio output can be tailored to the hearing of the user. Different embodiments on hearing enhancement through personalizing or tailoring to the hearing of the user have been described in the U.S. patent application Ser. No. 10/826,527, filed Apr. 15, 2004 now U.S. Pat. No. 7,388,962 and U.S. patent application Ser. No. 12/157,092 filed Jun. 6, 2008, and entitled, "Directional Hearing Enhancement Systems", which are hereby incorporated herein by reference.

In one embodiment, the wireless communication system can function both as a hearing aid and a cell phone. When there are no incoming calls, the system functions as a hearing aid. On the other hand, when there is an incoming call, instead of capturing audio signals in its vicinity, the system transmits the incoming call through the directional speaker to be received by the user. In another embodiment, the base unit and the interface unit are integrated together in a package, which again can be attached to the clothing by techniques previously described for the interface unit.

In yet another embodiment, an interface unit can include a monitor or a display. A user can watch television or video signals in public, again with reduced possibility of disturbing people in the immediate surroundings because the audio signals are directional. For wireless applications, video signals can be transmitted from the base unit to the interface unit through UWB signals.

The base unit can also include the capability to serve as a computation system, such as in a personal digital assistant (PDA) or a notebook computer. For example, as a user is working on the computation system for various tasks, the user can simultaneously communicate with another person in a hands-free manner using the interface unit, without the need to take her hands off the computation system. Data generated by a software application the user is working on using the computation system can be transmitted digitally with the voice signals to a remote device (e.g., another base station or unit). In this embodiment, the directional speaker does not have to be integrated or attached to the clothing of the user. Instead, the speaker can be integrated or attached to the computation system, and the computation can function as a cell phone. Directional audio signals from the phone call can be generated for the user while the user is still able to manipulate the computation system with both of his hands. The user can simultaneously make phone calls and use the computation system. In yet another approach for this embodiment, the computation system is also enabled to be connected wirelessly to a local area network, such as to a WiFi or WLAN network, which allows high-speed data as well as voice communication with the network. For example, the user can make voice over IP calls. In one embodiment, the high-speed data as well as voice communication permits signals to be transmitted wirelessly at frequencies beyond 1 GHz.

In yet another embodiment, the wireless communication system can be a personalized wireless communication system. The audio signals can be personalized to the hearing characteristics of the user of the system. The personalization process can be done periodically, such as once every year, similar to periodic re-calibration. Such re-calibration can be done by another device, and the results can be stored in a memory device. The memory device can be a removable media card, which can be inserted into the wireless communication system to personalize the amplification characteristics of the directional speaker as a function of frequency. The system can also include an equalizer that allows the user to personalize the amplitude of the speaker audio signals as a function of frequency.

The system can also be personalized based on the noise level in the vicinity of the user. The device can sense the noise level in its immediate vicinity and change the amplitude characteristics of the audio signals as a function of noise level.

The form factor of the interface unit can be quite compact. In one embodiment, it is rectangular in shape. For example, it can have a width of about "x", a length of about "2x", and a thickness that is less than "x". "X" can be 1.5 inches, or less than 3 inches. In another example, the interface unit has a thickness of less than 1 inch. In yet another example, the interface unit does not have to be flat. It can have a curvature to conform to the physical profile of the user.

A number of embodiments have been described with the speaker being directional. In one embodiment, a speaker is considered directional if the FWHM of its ultrasonic signals is less than about 1 radian or around 57 degrees. In another embodiment, a speaker is considered directional if the FWHM of its ultrasonic signals is less than about 30 degrees. In yet another embodiment, a speaker is transmitting from, such as, the shoulder of the user. The speaker is considered directional if in the vicinity of the user's ear or in the vicinity 6-8 inches away from the speaker, 75% of the power of its audio signals is within an area of less than 50 square inches. In a further embodiment, a speaker is considered directional if in the vicinity of the ear or in the vicinity a number of inches, such as 8 inches, away from the speaker, 75% of the power of its audio signals is within an area of less than 20 square inches. In yet a further embodiment, a speaker is considered directional if in the vicinity of the ear or in the vicinity a number of inches, such as 8 inches, away from the speaker, 75% of the power of its audio signals is within an area of less than 13 square inches.

Also, referring back to FIG. 6, in one embodiment, a speaker can be considered a directional speaker if most of the power of its audio signals is propagating in one general direction, confined within a cone, such as the cone 108 in FIG. 6, and the angle between the two sides or edges of the cone, such as shown in FIG. 6, is less than 60 degrees. In another embodiment, the angle between the two sides or edges of the cone is less than 45 degrees.

In a number of embodiments described above, the directional speaker generates ultrasonic signals in the range of 40 kHz. One of the reasons to pick such a frequency is for power efficiency. However, to reduce leakage, cross talk or to enhance privacy, in other embodiments, the ultrasonic signals utilized can be between 200 kHz to 1 MHz. It can be generated by multilayer piezoelectric thin films, or other types of solid state devices. Since the carrier frequency is at a higher frequency range than 40 kHz, the absorption/attenuation coefficient by air is considerably higher. For example, at 500 kHz, in one calculation, the attenuation coefficient $\alpha$ can be about 4.6, implying that the ultrasonic wave will be attenuated by $\exp(-\alpha*z)$ or about 40 dB/m. As a result, the waves are more quickly attenuated, reducing the range of operation of the speaker in the propagation direction of the ultrasonic waves. On the other hand, privacy is enhanced and audible interference to others is reduced.

The 500 kHz embodiment can be useful in a confined environment, such as inside a car. The beam can emit from the dashboard towards the ceiling of the car. In one embodiment, there can be a reflector at the ceiling to reflect the beam to the desired direction or location. In another embodiment, the beam can be further confined in a cavity or waveguide, such as a tube, inside the car. The beam goes through some distance inside the cavity, such as 2 feet, before emitting into free space within the car, and then received by a person, without the need for a reflector.

A number of embodiments of directional speakers have also been described where the resultant propagation direction of the ultrasonic waves is not orthogonal to the horizontal, but at, for example, 45 degrees. The ultrasonic waves can be at an angle so that the main beam of the waves is approximately pointed at an ear of the user. In another embodiment, the propagation direction of the ultrasonic waves can be approximately orthogonal to the horizontal. Such a speaker does not have to be on a wedge or a step. It can be on a surface that is substantially parallel to the horizontal. For example, the speaker can be on the shoulder of a user, and the ultrasonic waves propagate upwards, instead of at an angle pointed at an ear of the user. If the ultrasonic power is sufficient, the waves would have sufficient acoustic power even when the speaker is not pointing exactly at the ear.

One approach to explain the sufficiency in acoustic power is that the ultrasonic speaker generates virtual sources in the direction of propagation. These virtual sources generate secondary acoustic signals in numerous directions, not just along the propagation direction. This is similar to the antenna pattern which gives non-zero intensity in numerous directions away from the direction of propagation. In one such embodiment, the acoustic power is calculated to be from 45 to 50 dB SPL if (a) the ultrasonic carrier frequency is 500 kHz; (b) the audio frequency is 1 kHz; (c) the emitter size of the speaker is 3 cm×3 cm; (d) the emitter power (peak) is 140 dB SPL; (e) the emitter is positioned at 10 to 15 cm away from the ear, such as located on the shoulder of the user; and (f) with the ultrasonic beam pointing upwards, not towards the ear, the center of the ultrasonic beam is about 2-5 cm away from the ear.

In one embodiment, the ultrasonic beam is considered directed towards the ear as long as any portion of the beam, or the cone of the beam, is immediately proximate to, such as within 7 cm of, the ear. The direction of the beam does not have to be pointed at the ear. It can even be orthogonal to the ear, such as propagating up from one's shoulder, substantially parallel to the face of the person.

In yet another embodiment, the emitting surface of the ultrasonic speaker does not have to be flat. It can be designed to be concave or convex to eventually create a diverging ultrasonic beam. For example, if the focal length of a convex surface is f, the power of the ultrasonic beam would be 6 dB down at a distance of f from the emitting surface. To illustrate numerically, if f is equal to 5 cm, then after 50 cm, the ultrasonic signal would be attenuated by 20 dB.

A number of embodiments have been described where a device is attachable to the clothing worn by a user. In one embodiment, attachable to the clothing worn by a user includes wearable by the user. For example, the user can wear a speaker on his neck, like a pendant on a necklace. This also would be considered as attachable to the clothing worn by the user. From another perspective, the necklace can be considered as the "clothing" worn by the user, and the device is attachable to the necklace.

One or more of the above-described embodiments can be combined. For example, two directional speakers can be positioned one on each side of a notebook computer. As the user is playing games on the notebook computer, the user can communicate with other players using the microphone on the notebook computer and the directional speakers, again without taking his hands off a keyboard or a game console. Since the speakers are directional, audio signals are more confined to be directed to the user in front of the notebook computer.

Figure 14:
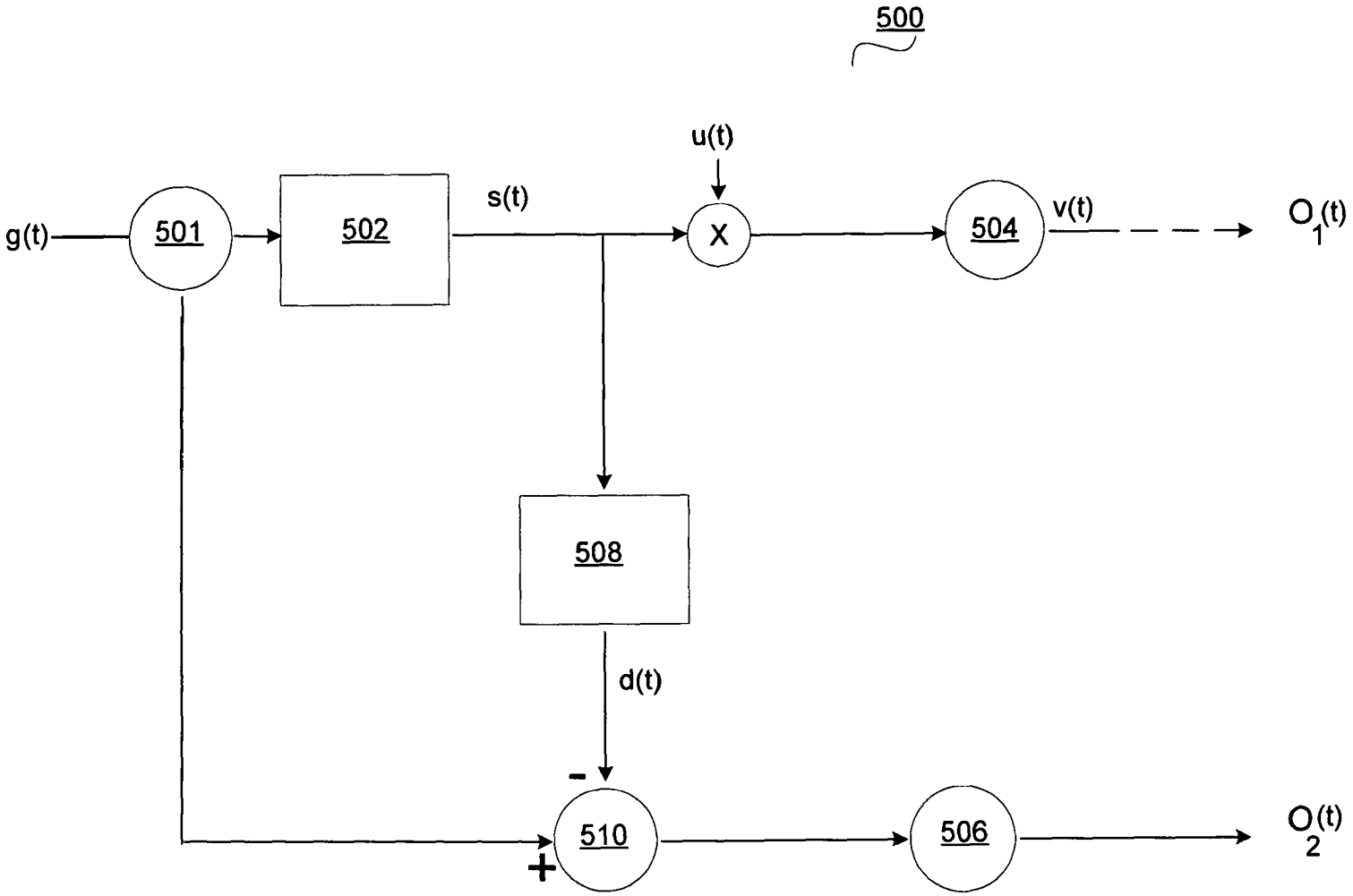
FIG. 14 shows a speaker apparatus including an ultrasonic speaker and a standard speaker according to another embodiment.

As described above, different embodiments can have at least two speakers, one ultrasonic speaker and one standard (non-ultrasonic) speaker. FIG. 14 shows such a speaker arrangement 500 according to one embodiment. In one embodiment, the speaker arrangement 500 includes at least one ultrasonic speaker 504 and at least one standard speaker 506. The ultrasonic speaker 504 can be configured to generate ultrasonic output signals v(t). The ultrasonic output signals v(t) can be transformed via a non-linear media, such as air, into ultrasonic-transformed audio output signals $O_1(t)$. The standard speaker 506 can be a speaker that generates standard audio output signals $O_2(t)$.

A standard speaker 506 can be audio signals (or audio sound) generated directly from the speaker 506 without the need for non-linear transformation of ultrasonic signals. For example, the standard speaker 506 can be an audio speaker. As one example, a standard speaker can be a speaker that is configured to output signals in the audio frequency range. As another example, a standard speaker can be a speaker that is configured to not generate ultrasonic frequencies. As yet another example, a standard speaker can be a speaker that is configured to not respond to ultrasonic frequency excitation at its input.

Figure 15:
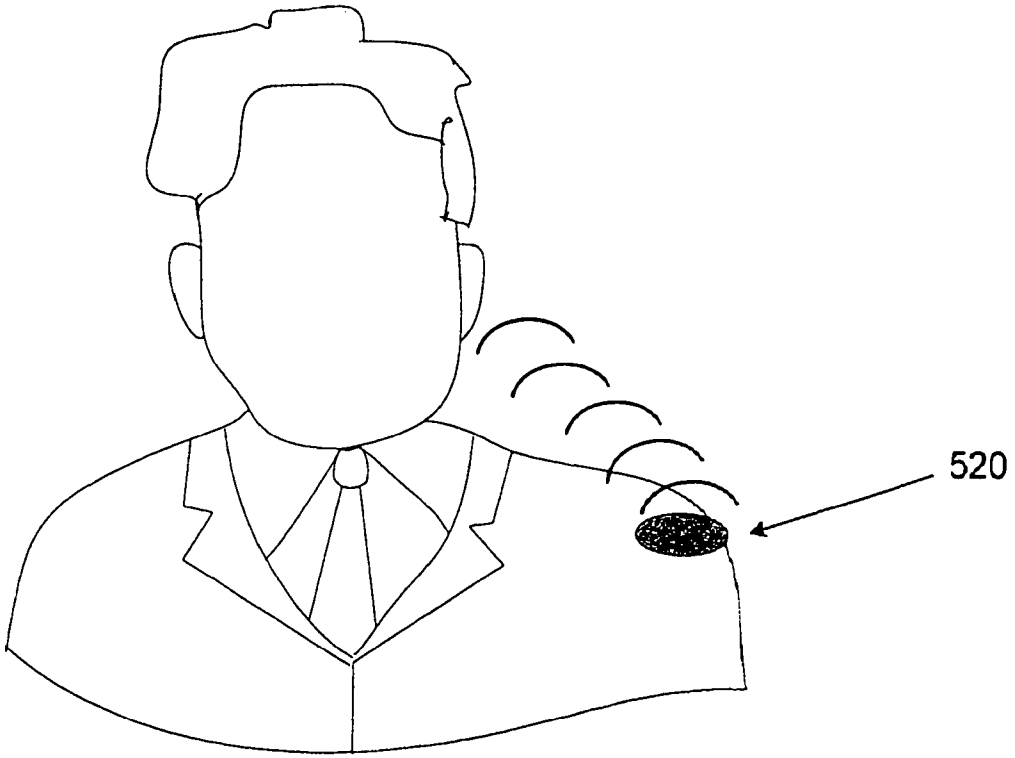
FIG. 15 shows a speaker apparatus on a shoulder of a person according to one embodiment.

In one approach, the speaker arrangement 500 with both speakers 504 and 506 can be embodied in a portable unit, which can be made suitable for portable or wearable applications. The portable unit can be placed near a user's shoulder, with its resulting audio outputs configured to be directed to one of the ears of the user. FIG. 15 shows one example of such a wearable device 520. In another approach, the speaker arrangement 500 with both speakers 504 and 506 can be embodied in a stationary unit, such as an entertainment unit, or can in general be stationary, such as mounted to a stationary object, like on a wall.

In one embodiment, the embodiment shown in FIG. 14 can also include a number of signal processing mechanisms. In one embodiment, audio input signals g(t) can be separated into two sectors (or ranges), a high frequency sector and a low frequency sector. The ultrasonic speaker 504 can be responsible for the high frequency sector, while the standard speaker 506 can be responsible for the low frequency sector. The high frequency sector of the audio input signals g(t) can be pre-processed by a pre-processor or a pre-processing compensator 502 to generate pre-processed signals s(t). The pre-processed signals s(t) can be used to modulate ultrasonic carrier signals u(t). The modulated ultrasonic signals can serve as inputs to the ultrasonic speaker 504 to produce ultrasonic output signals v(t). In one embodiment, the ultrasonic carrier signals u(t) can be represented as $\sin(2\pi f_c t)$. The ultrasonic output signals v(t) are relatively directionally constrained as they propagate, such as, in air. Also, as they propagate, the ultrasonic output signals v(t) can be self-demodulated into ultrasonic-transformed audio output signals $O_1(t)$.

In one embodiment, the pre-processing compensator 502 can be configured to enhance signal quality by, for example, compensating for at least some of the non-linear distortion effect in the ultrasonic-transformed audio output signals $O_1(t)$. An example of a pre-processing scheme is Single-Side Band (SSB) modulation. A number of other pre-processing schemes or compensation schemes have previously been described above.

Self-demodulation process in air of the ultrasonic output signals v(t) can lead to a −12 dB/octave roll-off. With air being a weak non-linear medium, one approach to compensate for the roll-off is to increase the signal power, such as the power of the audio input signals g(t) or the input power to the ultrasonic speaker 504. In one embodiment, the ultrasonic speaker 104 can have a relatively small aperture. For example, the aperture can be approximately circular, with a diameter in the order of a few centimeters, such as 5 cm. One way to provide higher ultrasonic power is to use a larger aperture for the ultrasonic speaker 504.

During self-demodulation, if the ultrasonic-transformed audio output signals $O_1(t)$ include signals in the low frequency sector, those signals typically can be significantly attenuated, which can cause pronounced loss of fidelity in the signals. One way to compensate for such loss can be to significantly increase the power in the low frequency sector of the audio input signals g(t), or the pre-processed signals s(t). But such high input power can drive the ultrasonic speaker 504 into saturation.

In one embodiment shown in FIG. 14, the speaker arrangement 500 can include a pre-processing compensator 502 configured to apply to the high frequency sector of the audio input signals g(t), but not to the low frequency sector of the audio input signals g(t). In one embodiment, the pre-processing compensator 502 can substantially block or filter signals in the low frequency sector, such that they are not subsequently generated via self-demodulation in air. In another embodiment, a filter 501 can filter the audio input signals g(t) such that signals in the high frequency sector can be substantially channeled to the pre-processing compensator 502 and signals in the low frequency sector can be substantially channeled to the standard speaker 506.

In one embodiment, the standard speaker 506 can be responsible for generating the audio output signals in the low frequency sector. Since a standard speaker 506 is typically more efficient (i.e., better power efficiency) than an ultrasonic speaker, particularly, in some instances, in generating signals in the low frequency sector, power efficiency of the speaker arrangement can be significantly improved, with the operating time of the power source correspondingly increased.

In one embodiment, the speaker arrangement 500 can optionally provide a distortion compensation unit 508 to provide additional distortion compensation circuitry. FIG. 14 shows another embodiment where the standard speaker 506 can also generate signals to further compensate for distortion in the ultrasonic-transformed audio output signals $O_1(t)$. This embodiment can include a feedback mechanism. In one embodiment of this approach, a distortion compensation unit 508 can try to simulate the non-linear distortion effect due to self-demodulation in air. For example, the distortion compensation unit 508 can include differentiating electronics to twice differentiate the pre-processed signals s(t) to generate the distortion compensated signals d(t). The distortion compensated signals d(t) can then be subtracted from the audio input signals g(t) by a combiner 510. The output from the combiner 510 (the subtracted signals) can serve as inputs to the standard audio speaker 506. For such an embodiment, distortion in the ultrasonic-transformed audio output signals $O_1(t)$, in principle, can be significantly (or even completely) cancelled by the corresponding output in the standard audio output signals $O_2(t)$. Thus, with the assistance of the distortion compensation unit 508, signal distortion due to the non-linear effect, in principle, can be significantly or even completely compensated, despite the difficult non-linear self-demodulation process.

One embodiment produces directional audio output signals without the need of a filter to separate the audio input signals g(t) into low frequency signals and high frequency signals. The embodiment includes a pre-processor 502, a distortion compensation unit 508, a modulator, an ultrasonic speaker 504, a standard audio speaker 506, and a combiner 510. The pre-processor 502 can be operatively connected to receive at least a portion of the audio input signals g(t) and to perform predetermined preprocessing on the audio input signals to produce pre-processed signals s(t). The distortion compensation unit 508 can be operatively connected to the pre-processor 502 to produce distortion compensated signals d(t) from the pre-processed signals s(t). The modulator can be operatively connected to the pre-processor 502 to modulate ultrasonic carrier signals u(t) by the pre-processed signals s(t) thereby producing modulated ultrasonic signals. The ultrasonic speaker 504 can be operatively connected to the modulator to receive the modulated ultrasonic signals and to output ultrasonic output signals v(t), which can be transformed into a first portion $O_1(t)$ of the audio output signals. The combiner 510 can be operatively connected to the distortion compensation unit 508 to subtract the distortion compensated signals d(t) from at least a portion of the audio input signals g(t) to generate inputs for the standard audio speaker 506 to output a second portion $O_2(t)$ of the audio output signals.

In one embodiment, digital signal processing (DSP) algorithms can be used to compute the electronics of the pre-processing compensator 502. DSP algorithms can also be used to compute electronics in the distortion compensation unit 508 to generate the distortion compensated signals d(t). Such algorithms can be used to compensate for the non-linear distortion effect in the audio output signals.

In one approach, the high frequency sector can be frequencies exceeding 500 Hz. In another embodiment, the high frequency sector can be frequencies exceeding 1 kHz.

In one embodiment, with a standard speaker being responsible for the low frequency sector and an ultrasonic speaker being responsible for the high frequency sector of the audio output signals, signals in the low frequency sector are typically more omni-directional than signals in the high frequency sector of the audio output signals. There are a number of approaches to reduce the possibility of compromising privacy due to signals in the low frequency sector being more omni-directional. In one embodiment, the standard speaker 506 can be configured to generate signals that are angularly constrained (e.g., to certain degrees), such as using a cone-shaped output device. In another embodiment, the power for the low frequency sector can be reduced. With the power intensity of the low frequency sector lowered, their corresponding audio output signals could be more difficult to discern.

Another embodiment to improve privacy is to inject into the pre-processed signals s(t), some random noise-like signals. The random noise-like signals again can be used to modulate the ultrasonic carrier signals u(t), and can be used as inputs to the distortion compensation unit 508. With the random noise-like signals being injected into the signal streams, positively (to the ultrasonic speaker) and negatively (to the standard speaker), their effect would be substantially cancelled at the desired user's ear. However, for the people who would hear little or none of the ultrasonic-transformed audio output signals $O_1(t)$, but would hear outputs from the standard speaker 506, the random noise-like signals from the standard speaker 506 would be more pronounced.

One way to represent the approximate extent of the ultrasonic-transformed audio output signals $O_1(t)$ from the ultrasonic speaker 504 is via a virtual column. It can be a fictitious column where one can hear the audio signals or audio sound. The length of the virtual column of the ultrasonic speaker 504 is typically limited by the attenuation of the ultrasonic signals in air. A lower ultrasonic frequency, such as below 40 kHz, leads to a longer (or a deeper) virtual column, while a higher ultrasonic frequency typically leads to a shorter virtual column.

In one embodiment, the ultrasonic speaker 504 can be configured to be for portable or wearable applications, where at least one of the ears of a user can be relatively close to the speaker. For example, the speaker 504 can be attached or worn on a shoulder of the user. In this situation, the virtual column does not have to be very long, and can be restricted in length to, for example, 20 cm. This is because the distance between the shoulder and one of the user's ears is typically not much more than 20 cm. Though a higher ultrasonic frequency typically has a higher attenuation, if the virtual column can be short, the effect of a higher attenuation may not be detrimental to usability. However, a higher attenuation can improve signal isolation or privacy.

In one embodiment, a standard speaker and an ultrasonic speaker can be in a unit, and the unit further includes a RF wireless transceiver, such as a short-range wireless communication device (e.g. Bluetooth device). The transceiver can be configured to allow the unit to communicate with another device, which can be a mobile phone.

In one embodiment, the ultrasonic output signals v(t) from an ultrasonic speaker can be steerable. One approach to steer uses phase array beam steering techniques.

In one embodiment, the size of a unit with both a standard speaker and an ultrasonic speaker is less than 5 cm×5 cm×1 cm, and can be operated by battery. The battery can be chargeable.

In one embodiment, an ultrasonic speaker can be implemented by at least a piezoelectric thin film transducer, a bimorph piezoelectric transducer or a magnetic film transducer.

In one embodiment, an ultrasonic speaker can be a piezoelectric transducer. The transducer includes a piezoelectric thin film, such as a polyvinylidiene di-fluoride (PVDF) film, deposited on a plate with a number of cylindrical tubes to create mechanical resonances. The film can be attached to the perimeter of the plate of tubes and can be biased by electrodes. Appropriate voltages applied via the electrodes to the piezoelectric thin film can create vibrations of the thin film, which in turn can generate modulated ultrasonic signals.

In another embodiment, the ultrasonic speaker can be a magnetic film transducer, which includes a magnetic coil thin film transducer with a permanent magnet. The thin film can vibrate up to 0.5 mm, which can be higher in magnitude than a piezoelectric thin film transducer.

In one embodiment, a unit with a standard speaker and an ultrasonic speaker, similar to the different embodiments as disclosed herein, can be configured to be used for a directional hearing enhancement system. Different embodiments have been described regarding a hearing enhancement system in U.S. patent application Ser. No. 10/826,527, filed Apr. 15, 2004, and entitled, "DIRECTIONAL HEARING ENHANCEMENT SYSTEMS," which is hereby incorporated herein by reference.

In one embodiment, a unit with a standard speaker and an ultrasonic speaker, similar to the different embodiments as disclosed herein, can be configured to be used for a portable electronic device. Different embodiments have been described regarding a portable electronic device in U.S. patent application Ser. No. 10/826,531, filed Apr. 15, 2004, and entitled, "DIRECTIONAL SPEAKER FOR PORTABLE ELECTRONIC DEVICE," which is hereby incorporated herein by reference.

In one embodiment, a unit with a standard speaker and an ultrasonic speaker, similar to the different embodiments as disclosed herein, can be configured to be used for localized delivery of audio sound. Different embodiments have been described regarding localized delivery of audio sound in U.S. patent application Ser. No. 10/826,537, filed Apr. 15, 2004, and entitled, "METHOD AND APPARATUS FOR LOCALIZED DELIVERY OF AUDIO SOUND FOR ENHANCED PRIVACY," which is hereby incorporated herein by reference.

In one embodiment, a unit with a standard speaker and an ultrasonic speaker, similar to the different embodiments as disclosed herein, can be configured to be used for wireless audio delivery. Different embodiments have been described regarding wireless audio delivery in U.S. patent application Ser. No. 10/826,528, filed Apr. 15, 2004, and entitled, "METHOD AND APPARATUS FOR WIRELESS AUDIO DELIVERY," which is hereby incorporated herein by reference.

Figure 16:
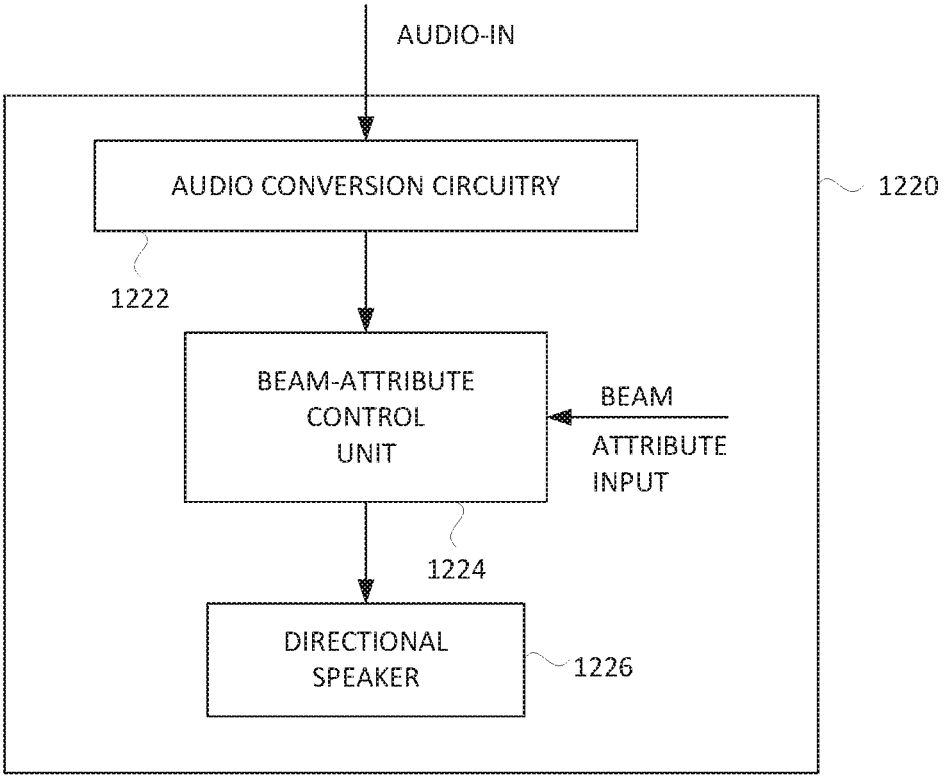
FIG. 16 is a block diagram of a directional audio delivery device according to an embodiment of the invention.

FIG. 16 is a block diagram of a directional audio delivery device 1220 according to an embodiment of the invention.

The directional audio delivery device 1220 includes audio conversion circuitry 1222, a beam-attribute control unit 1224 and a directional speaker 1226. The audio conversion circuitry 1222 converts the received audio signals into ultrasonic signals. The directional speaker 1226 receives the ultrasonic signals and produces an audio output. The beam-attribute control unit 1224 controls one or more attributes of the audio output.

One attribute can be the beam direction. The beam-attribute control unit 1224 receives a beam attribute input, which in this example is related to the direction of the beam. This can be known as a direction input. The direction input provides information to the beam-attribute control unit 1224 pertaining to a propagation direction of the ultrasonic output produced by the directional speaker 1226. The direction input can be a position reference, such as a position for the directional speaker 1226 (relative to its housing), the position of a person desirous of hearing the audio sound, or the position of an external electronic device (e.g., remote controller). Hence, the beam-attribute control unit 1224 receives the direction input and determines the direction of the audio output.

Another attribute can be the desired distance to be traveled by the beam. This can be known as a distance input. In one embodiment, the ultrasonic frequency of the audio output can be adjusted. By controlling the ultrasonic frequency, the desired distance traveled by the beam can be adjusted. This will be further explained below. Thus, with the appropriate control signals, the directional speaker 1226 generates the desired audio output accordingly.

One way to control the audio output level to be received by other users is through the distance input. By controlling the distance the ultrasonic output travels, the directional audio delivery device can minimize the audio output that might reach other persons.

Figure 17:
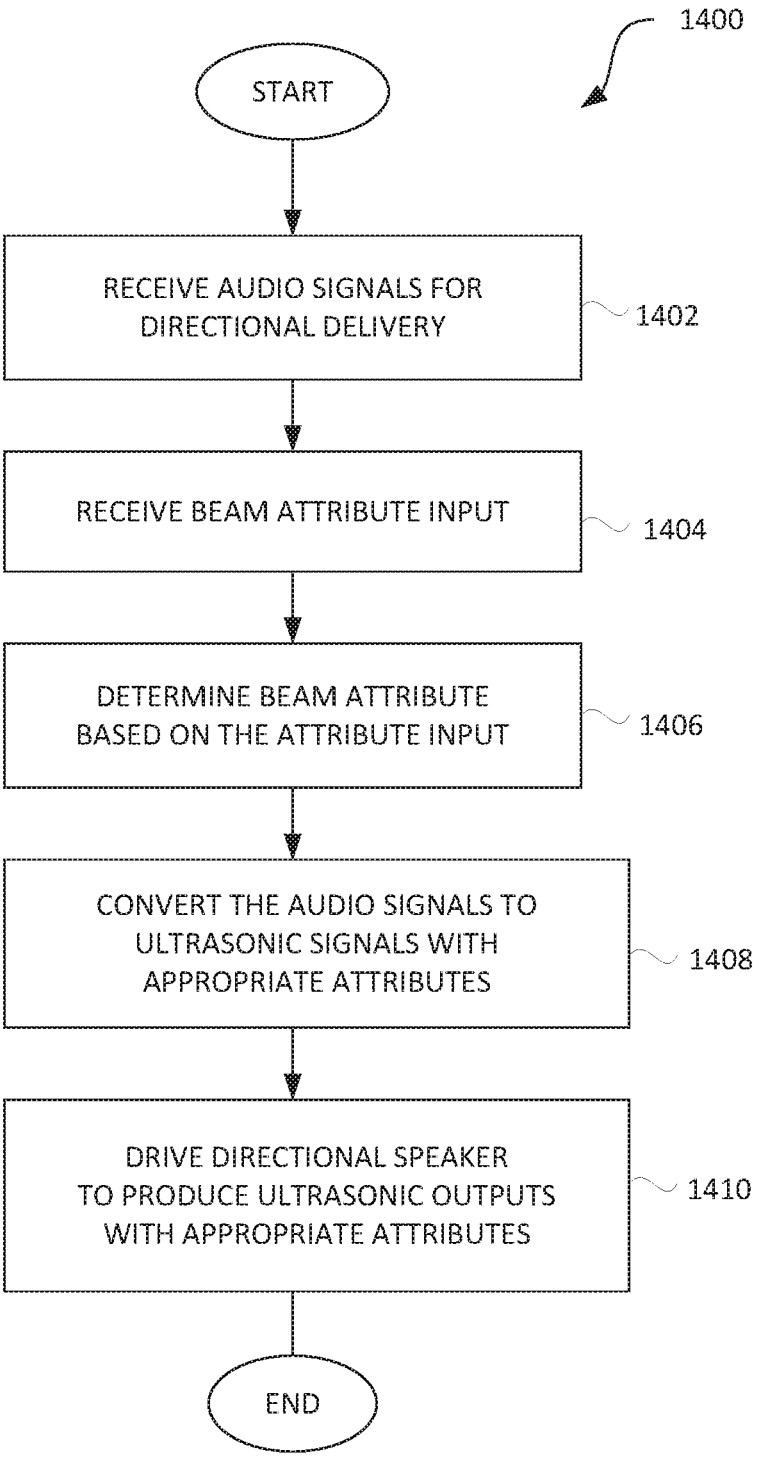
FIG. 17 is a flow diagram of directional audio delivery processing according to an embodiment of the invention.

FIG. 17 is a flow diagram of directional audio delivery processing 1400 according to an embodiment of the invention. The directional audio delivery processing 1400 is, for example, performed by a directional audio delivery device. More particularly, the directional audio delivery processing 1400 is particularly suitable for use by the directional audio delivery device 1220 illustrated in FIG. 16.

The directional audio delivery processing 1400 initially receives 1402 audio signals for directional delivery. The audio signals can be supplied by an audio system. In addition, a beam attribute input is received 1404. As previously noted, the beam attribute input is a reference or indication of one or more attributes regarding the audio output to be delivered. After the beam attribute input has been received 1404, one or more attributes of the beam are determined 1406 based on the attribute input. If the attribute pertains to the direction of the beam, the input can set the constrained delivery direction of the beam. The constrained delivery direction is the direction that the output is delivered. The audio signals that were received are converted 1408 to ultrasonic signals with appropriate attributes, which may include one or more of the determined attributes. Finally, the directional speaker is driven 1410 to generate ultrasonic output again with appropriate attributes. In the case where the direction of the beam is set, the ultrasonic output is directed in the constrained delivery direction. Following the operation 1410, the directional audio delivery processing 1400 is complete and ends. Note that the constrained delivery direction can be altered dynamically or periodically, if so desired.

Figure 18:
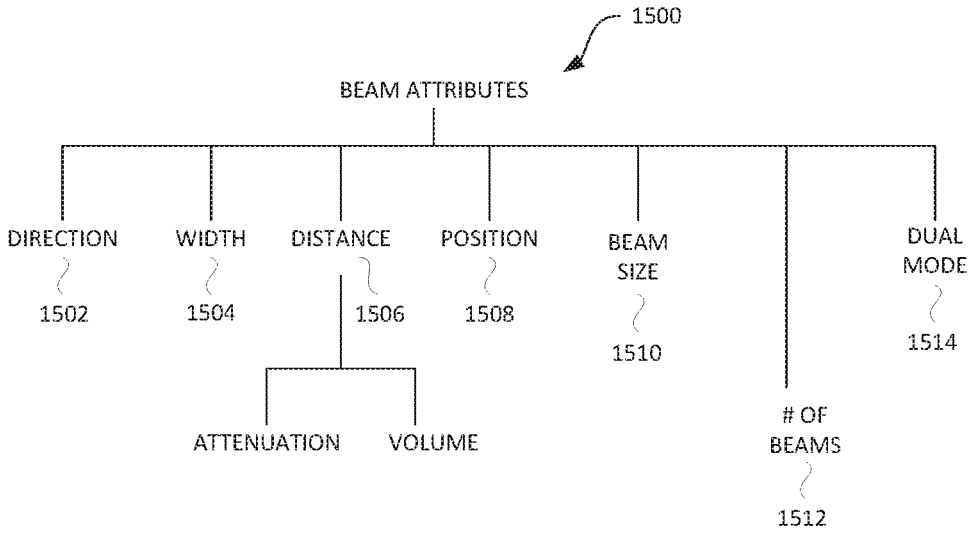
FIG. 18 shows examples of attributes of the constrained audio output according to the invention.

FIG. 18 shows examples of beam attributes 1500 of the constrained audio output according to the invention. These beam attributes 1500 can be provided either automatically, such as periodically, or manually, such as at the request of a user. The attributes can be for the beam-attribute control unit 1224. One attribute, which has been previously described, is the direction 1502 of the beam. Another attribute can be the beam width 1504. In other words, the width of the ultrasonic output can be controlled. In one embodiment, the beam width is the width of the beam at the desired position. For example, if the desired location is 10 feet directly in front of the directional audio apparatus, the beam width can be the width of the beam at that location. In another embodiment, the width 1504 of the beam is defined as the width of the beam at its full-width-half-max (FWHM) position.

The desired distance 1506 to be covered by the beam can be set. In one embodiment, the rate of attenuation of the ultrasonic output/audio output can be controlled to set the desired distance. In another embodiment, the volume or amplification of the beam can be changed to control the distance to be covered. Through controlling the desired distance, other persons in the vicinity of the person to be receiving the audio signals (but not adjacent thereto) would hear little or no sound. If sound were heard by such other persons, its sound level would have been substantially attenuated (e.g., any sound heard would be faint and likely not discernable).

There are also other types of beam attribute inputs. For example, the inputs can be the position 1508, and the size 1510 of the beam. The position input can pertain to the position of a person desirous of hearing the audio sound, or the position of an electronic device (e.g., remote controller). Hence, the beam-attribute control unit 1224 receives the beam position input and the beam size input, and then determines how to drive the directional speaker to output the audio sound to a specific position with the appropriate beam width. Then, the beam-attribute control unit 1224 produces drive signals, such as ultrasonic signals and other control signals. The drive signals controls the directional speaker to generate the ultrasonic output towards a certain position with a particular beam size.

There can be more than one beam. Hence, one attribute of the beam is the number 1512 of beams present. Multiple beams can be utilized, such that multiple persons are able to receive the audio signals via the ultrasonic output by the directional speaker (or a plurality of directional speakers). Each beam can have its own attributes.

There can also be a dual mode operation 1514 having a directional mode and a normal mode. The directional audio apparatus can include a normal speaker (e.g., substantially omni-directional speaker). There are situations where a user would prefer the audio output to be heard by everyone in a room, for example. Under this situation, the user can deactivate the directional delivery mechanism of the apparatus, or can allow the directional audio apparatus to channel the audio signals to the normal speaker to generate the audio output. In one embodiment, a normal speaker generates its audio output based on audio signals, without the need for generating ultrasonic outputs. However, a directional speaker requires ultrasonic signals to generate its audio output.

In one embodiment, the beam from a directional speaker can propagate towards the ceiling of a building, which reflects the beam back towards the floor to be received by users. One advantage of such an embodiment is to lengthen the propagation distance to broaden the width of the beam when it reaches the users. Another feature of this embodiment is that the users do not have to be in the line-of-sight of the directional audio apparatus.

Figure 19:
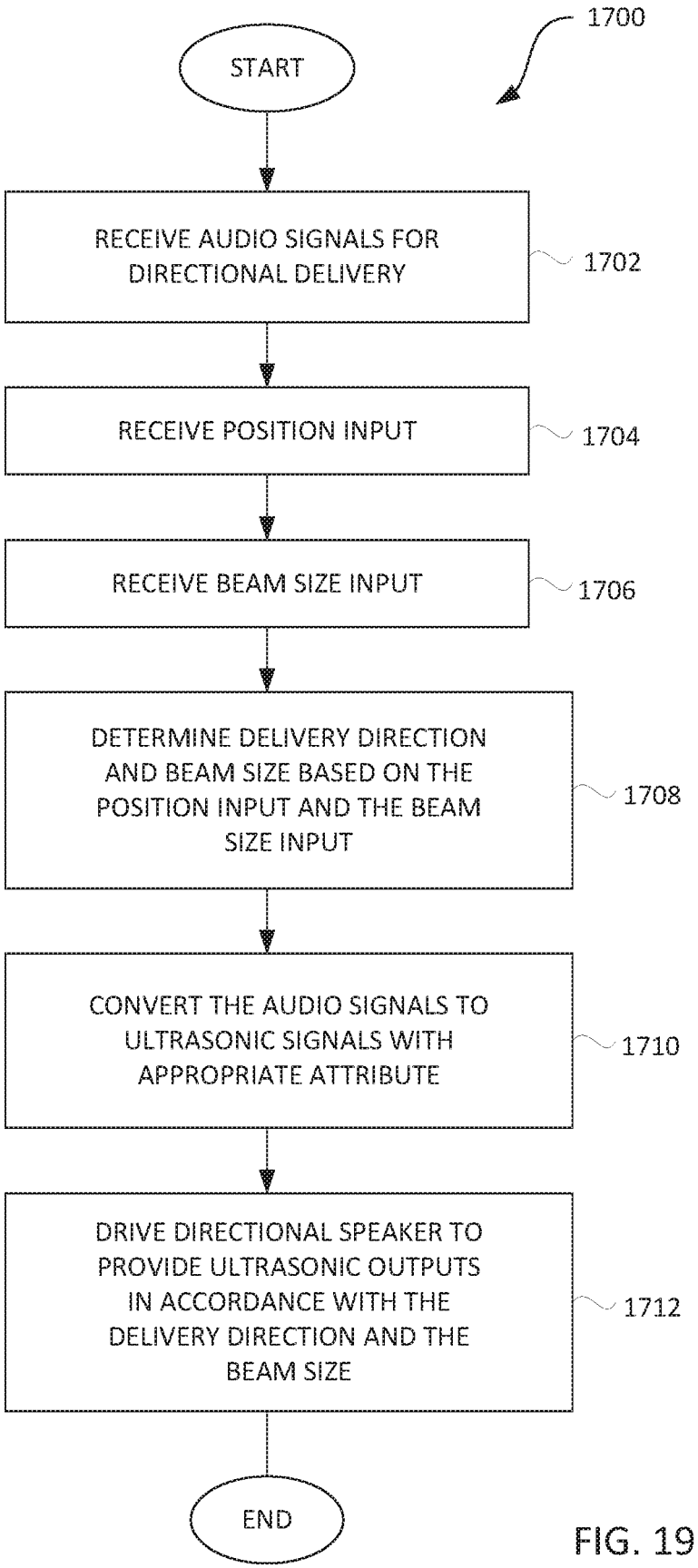
FIG. 19 is a flow diagram of directional audio delivery processing according to another embodiment of the invention.

FIG. 19 is a flow diagram of directional audio delivery processing 1700 according to another embodiment of the invention. The directional audio delivery processing 1700 is, for example, performed by a directional audio delivery device. More particularly, the directional audio delivery processing 1700 is particularly suitable for use by the directional audio delivery device 1220 illustrated in FIG. 16.

The directional audio delivery processing 1700 receives 1702 audio signals for directional delivery. The audio signals are provided by an audio system. In addition, two beam attribute inputs are received, and they are a position input 1704 and a beam size input 1706. Next, the directional audio delivery processing 1700 determines 1708 a delivery direction and a beam size based on the position input and the beam size input. The desired distance to be covered by the beam can also be determined. The audio signals are then converted 1710 to ultrasonic signals, with the appropriate attributes. For example, the frequency and/or the power level of the ultrasonic signals can be generated to set the desired travel distance of the beam. Thereafter, a directional speaker (e.g., ultrasonic speaker) is driven 1712 to generate ultrasonic output in accordance with, for example, the delivery direction and the beam size. In other words, when driven 1712, the directional speaker produces ultrasonic output (that carries the audio sound) towards a certain position, with a certain beam size at that position. In one embodiment, the ultrasonic signals are dependent on the audio signals, and the delivery direction and the beam size are used to control the directional speaker. In another embodiment, the ultrasonic signals can be dependent on not only the audio signals but also the delivery direction and the beam size. Following the operation 1712, the directional audio delivery processing 1700 is complete and ends.

Figure 20A:
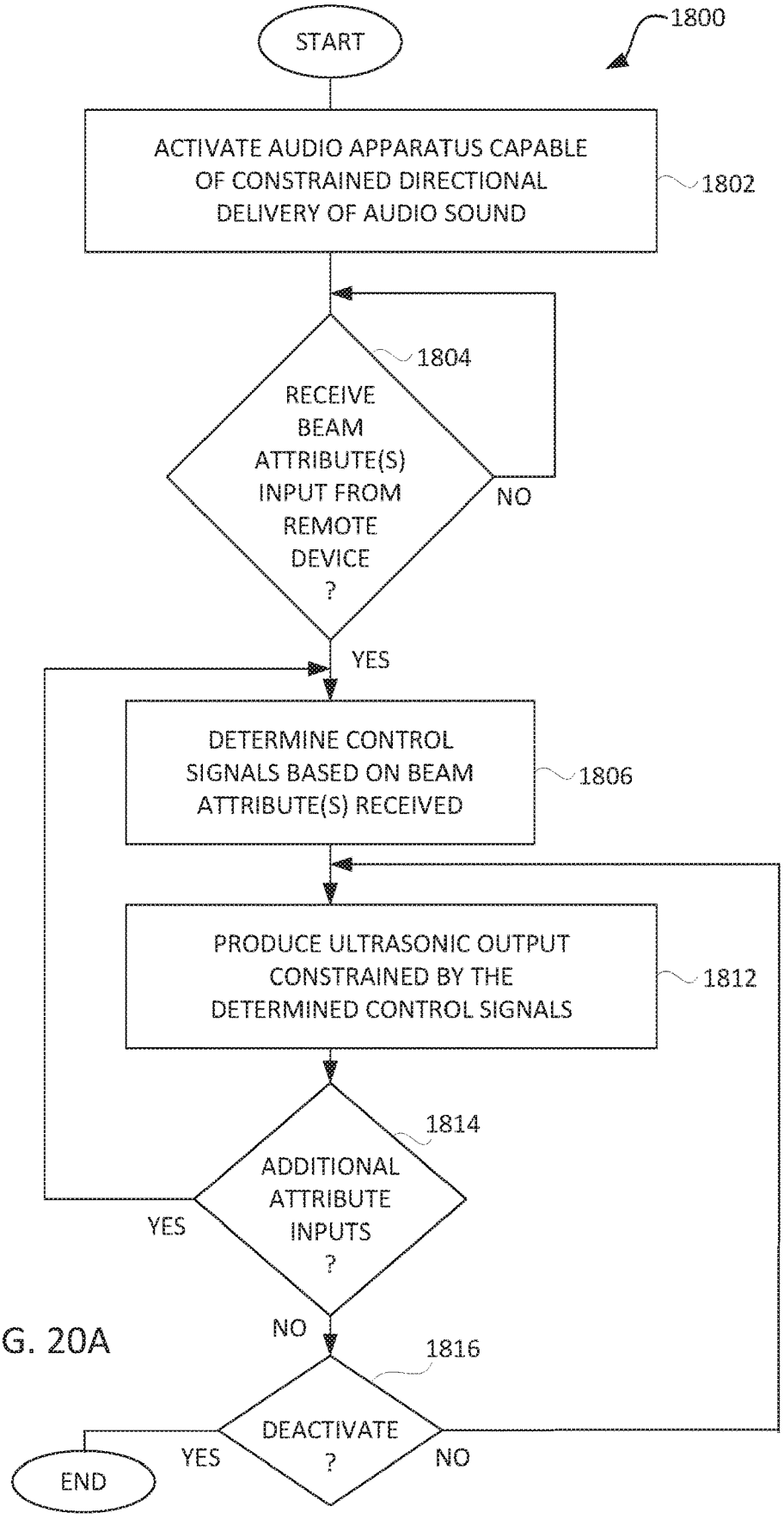
FIG. 20A is a flow diagram of directional audio delivery processing according to yet another embodiment of the invention.

FIG. 20A is a flow diagram of directional audio delivery processing 1800 according to yet another embodiment of the invention. The directional audio delivery processing 1800 is, for example, suitable for use by a directional audio delivery device. More particularly, the directional audio delivery processing 1800 is particularly suitable for use by the directional audio delivery device 1220 illustrated in FIG. 16, with the beam attribute inputs being beam position and beam size received from a remote device.

The directional audio delivery processing 1800 initially activates a directional audio apparatus that is capable of constrained directional delivery of audio sound. A decision 1804 determines whether a beam attribute input has been received. Here, in accordance with one embodiment, the audio apparatus has associated with it a remote control device, and the remote control device can provide the beam attributes. Typically, the remote control device enables a user positioned remotely (e.g., but in line-of-sight) to change settings or characteristics of the audio apparatus. One beam attribute is the desired location of the beam. Another attribute is the beam size. According to the invention, a user of the audio apparatus might hold the remote control device and signal to the directional audio apparatus a position reference. This can be done by the user, for example, through selecting a button on the remote control device. This button can be the same button for setting the beam size because in transmitting beam size information, location signals can be relayed as well. The beam size can be signaled in a variety of ways, such as via a button, dial or key press, using the remote control device. When the decision 1804 determines that no attributes have been received from the remote control device, the decision 1804 can just wait for an input.

When the decision 1804 determines that a beam attribute input has been received from the remote control device, control signals for the directional speaker are determined 1806 based on the attribute received. If the attribute is a reference position, a delivery direction can be determined based on the position reference. If the attribute is for a beam size adjustment, control signals for setting a specific beam size are determined. Then, based on the control signals determined, the desired ultrasonic output that is constrained is produced 1812.

Next, a decision 1814 determines whether there are additional attribute inputs. For example, an additional attribute input can be provided to incrementally increase or decrease the beam size. The user can adjust the beam size, hear the effect and then further adjust it, in an iterative manner. When the decision 1814 determines that there are additional attribute inputs, appropriate control signals are determined 1806 to adjust the ultrasonic output accordingly. When the decision 1814 determines that there are no additional inputs, the directional audio apparatus can be deactivated. When the decision 1816 determines that the audio system is not to be deactivated, then the directional audio delivery processing 1800 returns to continuously output the constrained audio output. On the other hand, when the decision 1816 determines that the directional audio apparatus is to be deactivated, then the directional audio delivery processing 1800 is complete and ends.

Besides directionally constraining audio sound that is to be delivered to a user, the audio sound can optionally be additionally altered or modified in view of the user's hearing characteristics or preferences, or in view of the audio conditions in the vicinity of the user.

Figure 20B:
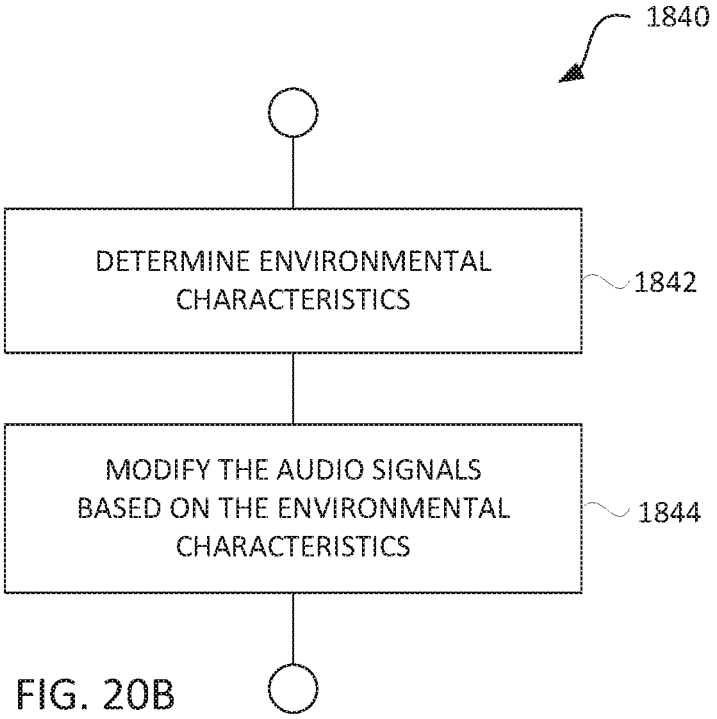
FIG. 20B is a flow diagram of an environmental accommodation process according to one embodiment of the invention.

FIG. 20B is a flow diagram of an environmental accommodation process 1840 according to one embodiment of the invention. The environmental accommodation process 1840 determines 1842 environmental characteristics. In one implementation, the environmental characteristics can pertain to measured sound (e.g., noise) levels at the vicinity of the user. The sound levels can be measured by a pickup device (e.g., microphone) at the vicinity of the user. The pickup device can be at the remote device held by the user. In another implementation, the environmental characteristics can pertain to estimated sound (e.g., noise) levels at the vicinity of the user. The sound levels at the vicinity of the user can be estimated based on a position of the user/device and/or the estimated sound level for the particular environment. For example, sound level in a department store is higher than the sound level in the wilderness. The position of the user can, for example, be determined by Global Positioning System (GPS) or other triangulation techniques, such as based on infrared, radio-frequency or ultrasound frequencies with at least three non-collinear receiving points. There can be a database with information regarding typical sound levels at different locations. The database can be accessed to retrieve the estimated sound level based on the specific location.

After the environmental accommodation process 1840 determines 1842 the environmental characteristics, the audio signals are modified based on the environmental characteristics. For example, if the user were in an area with a lot of noise (e.g., ambient noise), such as at a confined space with various persons or where construction noise is present, the audio signals could be processed to attempt to suppress the unwanted noise, and/or the audio signals (e.g., in a desired frequency range) could be amplified. One approach to suppress the unwanted noise is to introduce audio outputs that are opposite in phase to the unwanted noise so as to cancel the noise. In the case of amplification, if noise levels are excessive, the audio output might not be amplified to cover the noise because the user might not be able to safely hear the desired audio output. In other words, there can be a limit to the amount of amplification and there can be negative amplification on the audio output (even complete blockage) when excessive noise levels are present. Noise suppression and amplification can be achieved through conventional digital signal processing, amplification and/or filtering techniques. The environmental accommodation process 1840 can, for example, be performed periodically or if there is a break in audio signals for more than a preset amount of time. The break may signify that there is a new audio stream.

A user might have a hearing profile that contains the user's hearing characteristics. The audio sound provided to the user can optionally be customized or personalized to the user by altering or modifying the audio signals in view of the user's hearing characteristics. By customizing or personalizing the audio signals to the user, the audio output can be enhanced for the benefit or enjoyment of the user.

Figure 20C:
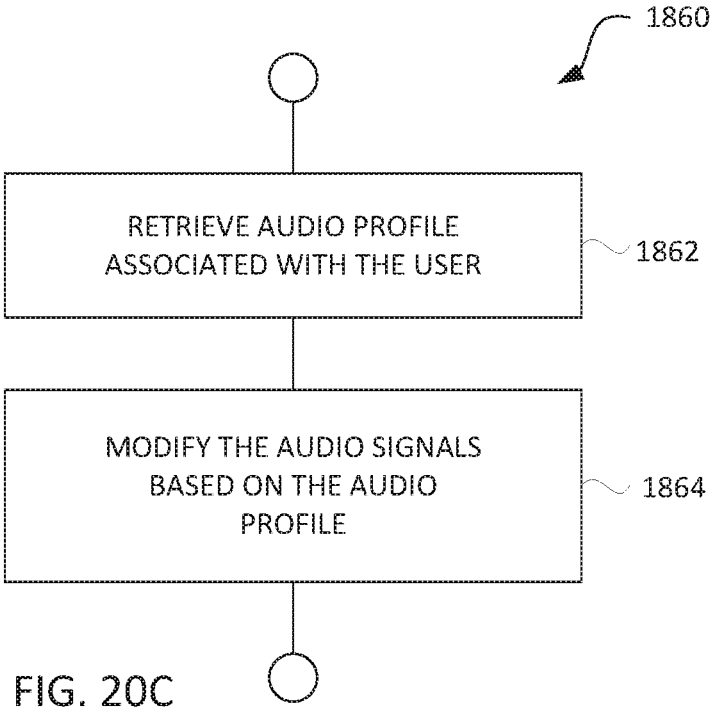
FIG. 20C is a flow diagram of audio personalization process according to one embodiment of the invention.

FIG. 20C is a flow diagram of an audio personalization process 1860 according to one embodiment of the invention. The audio personalization process 1860 retrieves 1862 an audio profile associated with the user. The hearing profile contains information that specifies the user's hearing characteristics. For example, the hearing characteristics may have been acquired by the user taking a hearing test. Then, the audio signals are modified 1864 or pre-processed based on the audio profile associated with the user.

The hearing profile can be supplied to a directional audio delivery device performing the personalization process 1860 in a variety of different ways. For example, the audio profile can be electronically provided to the directional audio delivery device through a network. As another example, the audio profile can be provided to the directional audio delivery device by way of a removable data storage device (e.g., memory card). Additional details on audio profiles and personalization to enhance hearing can be found in U.S. patent application Ser. No. 19/826,527, filed Apr. 15, 2004, now U.S. Pat. No. 7,388,962, entitled "DIRECTIONAL HEARING ENHANCEMENT SYSTEMS", which is hereby incorporated herein by reference.

The environmental accommodation process 1840 and/or the audio personalization process 1860 can optionally be performed together with any of the directional audio delivery devices or processes discussed above. For example, the environmental accommodation process 1840 and/or the audio personalization process 1860 can optionally be performed together with any of the directional audio delivery processes 1400, 1700 or 1800 embodiments discussed above with respect to FIGS. 17, 19 and 20. The environmental accommodation process 1840 and/or the audio personalization process 1860 typically would precede the operation 1408 in FIG. 17, the operation 1710 in FIG. 19 and/or the operation 1812 in FIG. 20A.

Figure 21A:
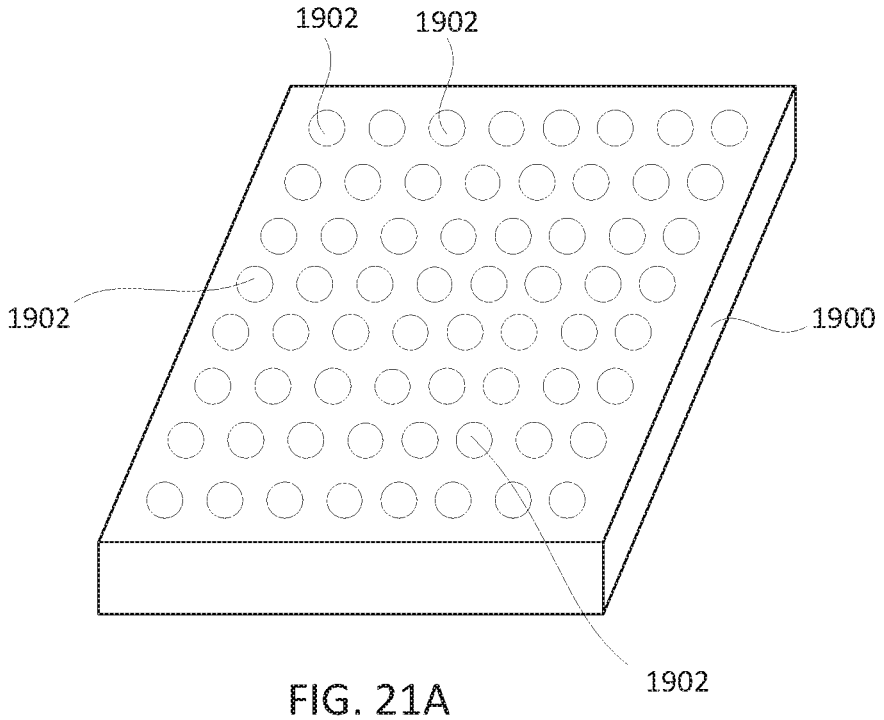
FIG. 21A is a perspective diagram of an ultrasonic transducer according to one embodiment of the invention.

FIG. 21A is a perspective diagram of an ultrasonic transducer 1900 according to one embodiment of the invention. The ultrasonic transducer 1900 can implement the directional speakers discussed herein. The ultrasonic transducer 1900 produces the ultrasonic output utilized as noted above. In one embodiment, the ultrasonic transducer 1900 includes a plurality of resonating tubes 1902 covered by a piezoelectric thin-film, such as PVDF, that is under tension. When the film is driven by a voltage at specific frequencies, the structure will resonate to produce the ultrasonic output.

Mathematically, the resonance frequency f of each eigen mode (n,s) of a circular membrane can be represented by:

$$f(n,s)=\alpha(n,s)/(2\pi a)*\sqrt{(S/m)}$$

where a is the radius of the circular membrane,

S is the uniform tension per unit length of boundary, and

M is the mass of the membrane per unit area.

For different eigen modes of the tube structure shown in FIG. 21A, $\alpha(0,0)=2.4$ $\alpha(0,1)=5.52$ $\alpha(0,2)=8.65$

. . .

Assume $\alpha(0,0)$ to be the fundamental resonance frequency, and is set to be at 50 kHz. Then, $\alpha(0,1)$ is 115 kHz, and $\alpha(0,2)$ is 180 kHz etc. The n=0 modes are all axisymmetric modes. In one embodiment, by driving the thin-film at the appropriate frequency, such as at any of the axisymmetric mode frequencies, the structure resonates, generating ultrasonic waves at that frequency.

Instead of using a membrane over the resonating tubes, in another embodiment, the ultrasonic transducer is made of a number of speaker elements, such as unimorph, bimorph or other types of multilayer piezoelectric emitting elements. The elements can be mounted on a solid surface to form an array. These emitters can operate at a wide continuous range of frequencies, such as from 40 to 200 kHz.

One embodiment to control the distance of propagation of the ultrasonic output is by changing the carrier frequency, such as from 40 to 200 kHz. Frequencies in the range of 200 kHz have much higher acoustic attenuation in air than frequencies around 40 kHz. Thus, the ultrasonic output can be attenuated at a much faster rate at higher frequencies, reducing the potential risk of ultrasonic hazard to health, if any. Note that the degree of attenuation can be changed continuously, such as based on multi-layer piezoelectric thin-film devices by continuously changing the carrier frequency. In another embodiment, the degree of isolation can be changed more discreetly, such as going from one eigen mode to another eigen mode of the tube resonators with piezoelectric membranes.

Figure 21B:
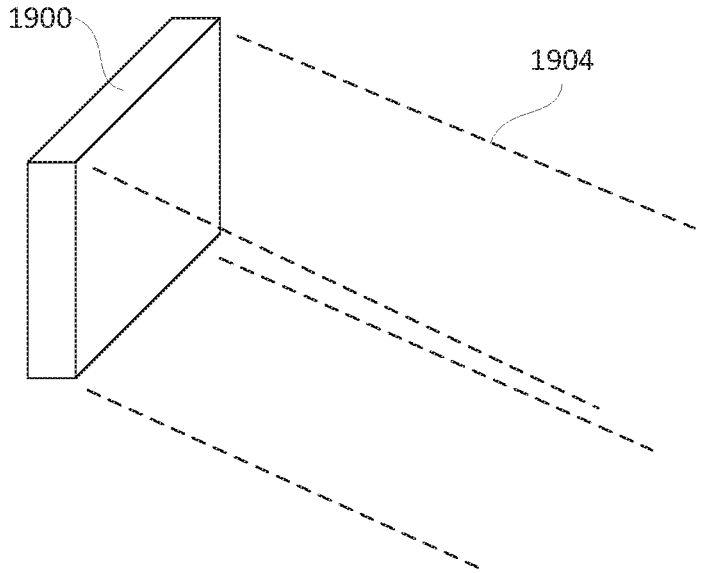
FIG. 21B is a diagram that illustrates the ultrasonic transducer with its beam being produced for audio output according to an embodiment of the invention.

FIG. 21B is a diagram that illustrates the ultrasonic transducer 1900 generating its beam 1904 of ultrasonic output.

Figure 21C:
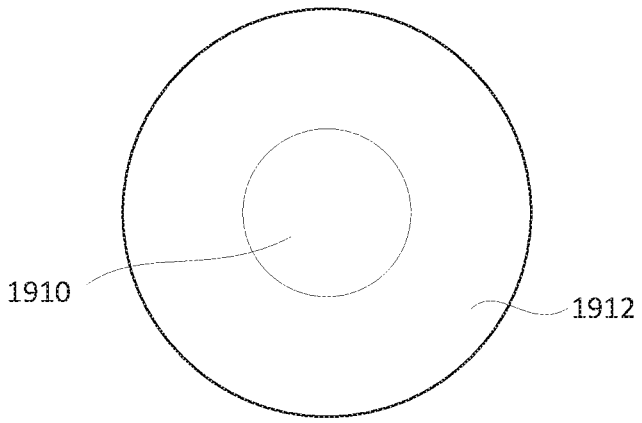
FIGS. 21C-21D illustrate two embodiments of the invention where the directional speakers are segmented.
Figure 21D:
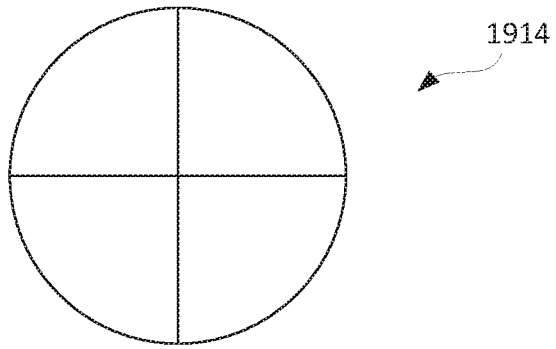

The width of the beam 1904 can be varied in a variety of different ways. For example, a reduced area or one segment of the transducer 1900 can be used to decrease the width of the beam 1904. In the case of a membrane over resonating tubes, there can be two concentric membranes, an inner one 1910 and an outer one 1912, as shown in FIG. 21C. One can turn on the inner one only, or both at the same time with the same frequency, to control the beam width. FIG. 21D illustrates another embodiment 1914, with the transducer segmented into four quadrants. The membrane for each quadrant can be individually controlled. They can be turned on individually, or in any combination to control the width of the beam. In the case of directional speakers using an array of bimorph elements, reduction of the number of elements can be used to reduce the size of the beam width. Another approach is to activate elements within specific segments to control the beam width.

Figure 21E:
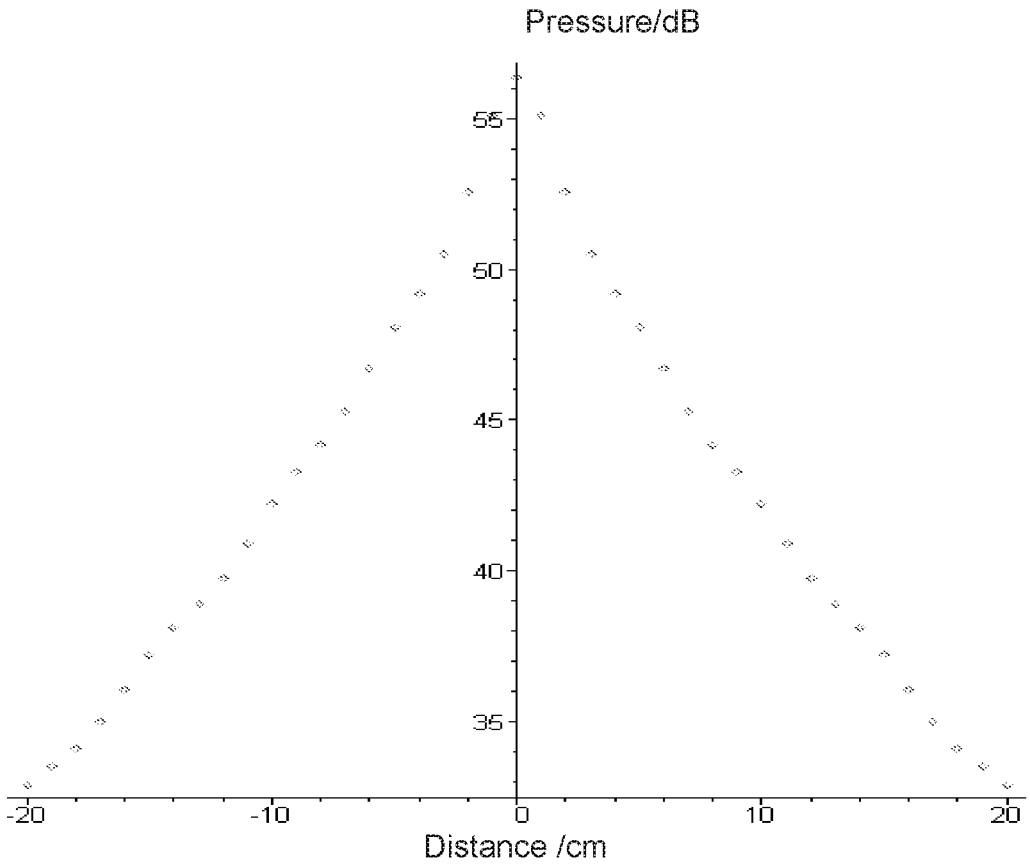
FIGS. 21E-21G show changes in beam width based on different carrier frequencies according to different embodiments of the present invention.
Figure 21F:
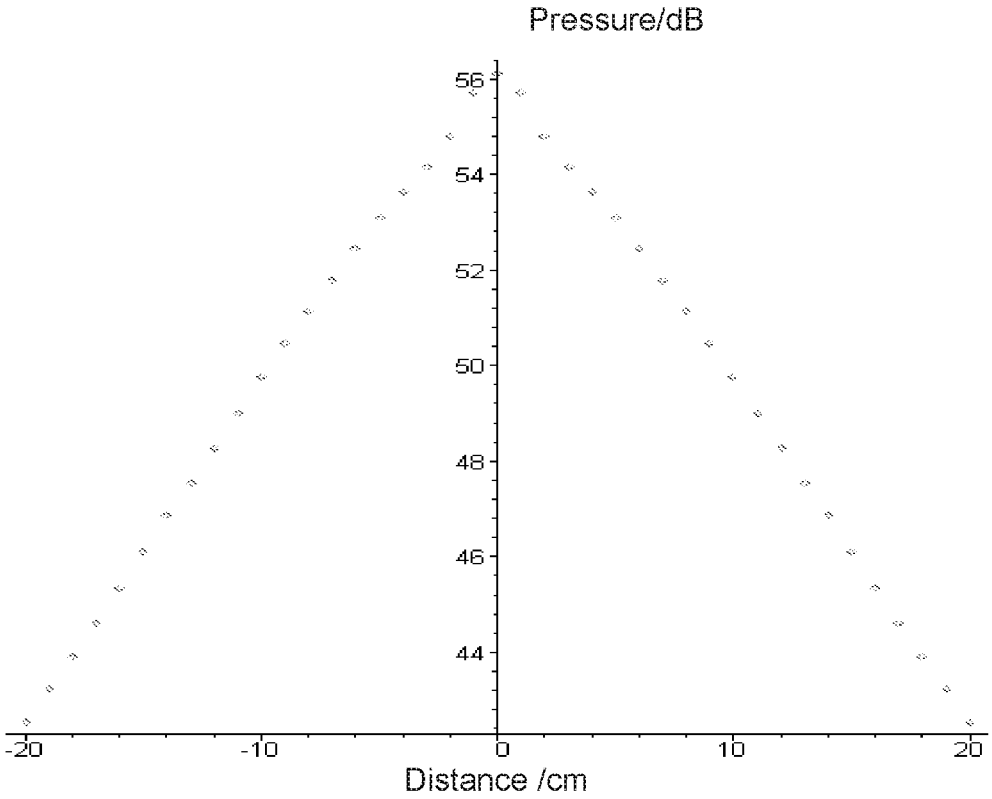
Figure 21G:
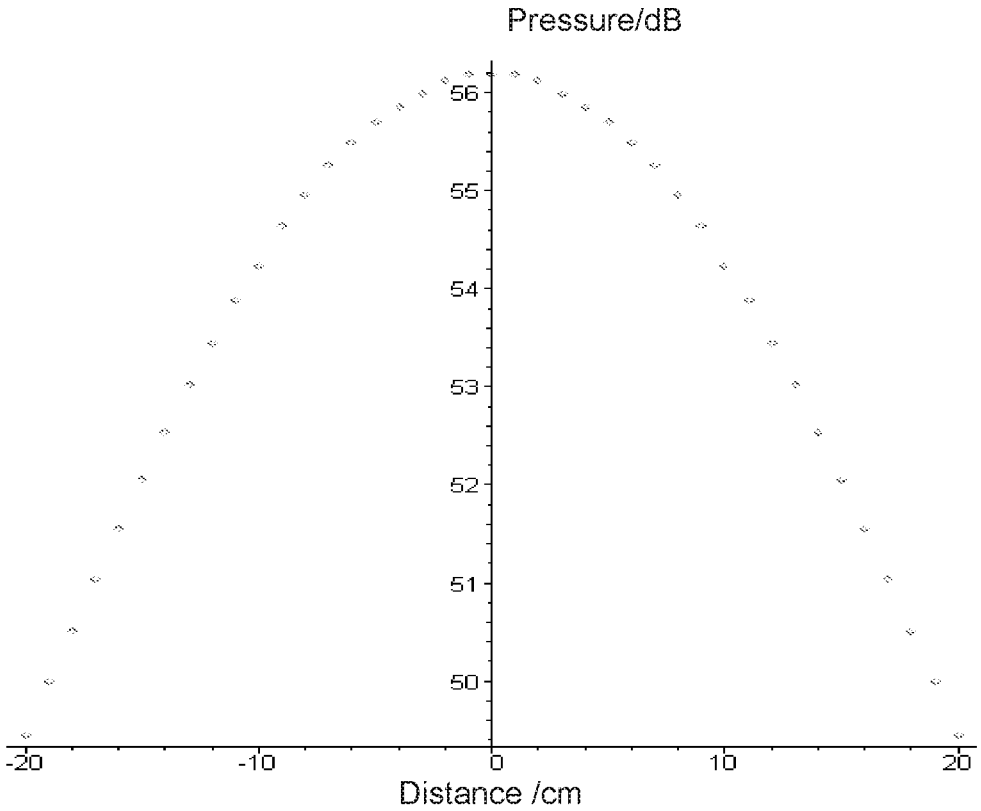

In yet another embodiment, the width of the beam can be broadened by increasing the frequency of the ultrasonic output. To illustrate this embodiment, the dimensions of the directional speaker are made to be much larger than the ultrasonic wavelengths. As a result, beam divergence based on aperture diffraction is relatively small. One reason for the increase in beam width in this embodiment is due to the increase in attenuation as a function of the ultrasonic frequency. Examples are shown in FIGS. 21E-21G, with the ultrasonic frequencies being 40 kHz, 100 kHz and 200 kHz, respectively. These figures illustrate the audio output beam patterns computed by integrating the non-linear KZK equation based on an audio frequency at 1 kHz. The emitting surface of the directional speaker is assumed to be a planar surface of 20 cm by 10 cm. Such equations are described, for example, in "Quasi-plane waves in the nonlinear acoustics of confined beams," by E. A. Zabolotskaya and R. V. Khokhov, which appeared in Sov. Phys. Acoust., Vol. 15, pp. 35-40, 1969; and "Equations of nonlinear acoustics," by V. P. Kuznetsov, which appeared in Sov. Phys. Acoust., Vol. 16, pp. 467-470, 1971.

In the examples shown in FIGS. 21E-21G, the acoustic attenuations are assumed to be 0.2 per meter for 40 kHz, 0.5 per meter for 100 kHz and 1.0 per meter for 200 kHz. The beam patterns are calculated at a distance of 4 m away from the emitting surface and normal to the axis of propagation. The x-axis of the figures indicates the distance of the test point from the axis (from −2 m to 2 m), while the y-axis of the figures indicates the calculated acoustic pressure in dB SPL of the audio output at the test point. The emitted power for the three examples are normalized so that the received power for the three audio outputs on-axis are roughly the same (e.g. at 56 dB SPL 4 m away). Comparing the figures, one can see that the lowest carrier frequency (40 kHz in FIG. 21E) gives the narrowest beam and the highest carrier frequency (200 kHz in FIG. 21G) gives the widest beam. One explanation can be that higher acoustic attenuation reduces the length of the virtual array of speaker elements, which tends to broaden the beam pattern. Anyway, in this embodiment, a lower carrier frequency provides better beam isolation, with privacy enhanced.

As explained, the audio output is in a constrained beam for enhanced privacy. Sometimes, although a user would not want to disturb other people in the immediate neighborhood, the user may want the beam to be wider or more divergent. A couple may be sitting together to watch a movie. Their enjoyment would be reduced if one of them cannot hear the movie because the beam is too narrow. In a number of embodiments to be described below, the width of the beam can be expanded in a controlled manner based on curved structural surfaces or other phase-modifying beam forming techniques.

Figure 22:
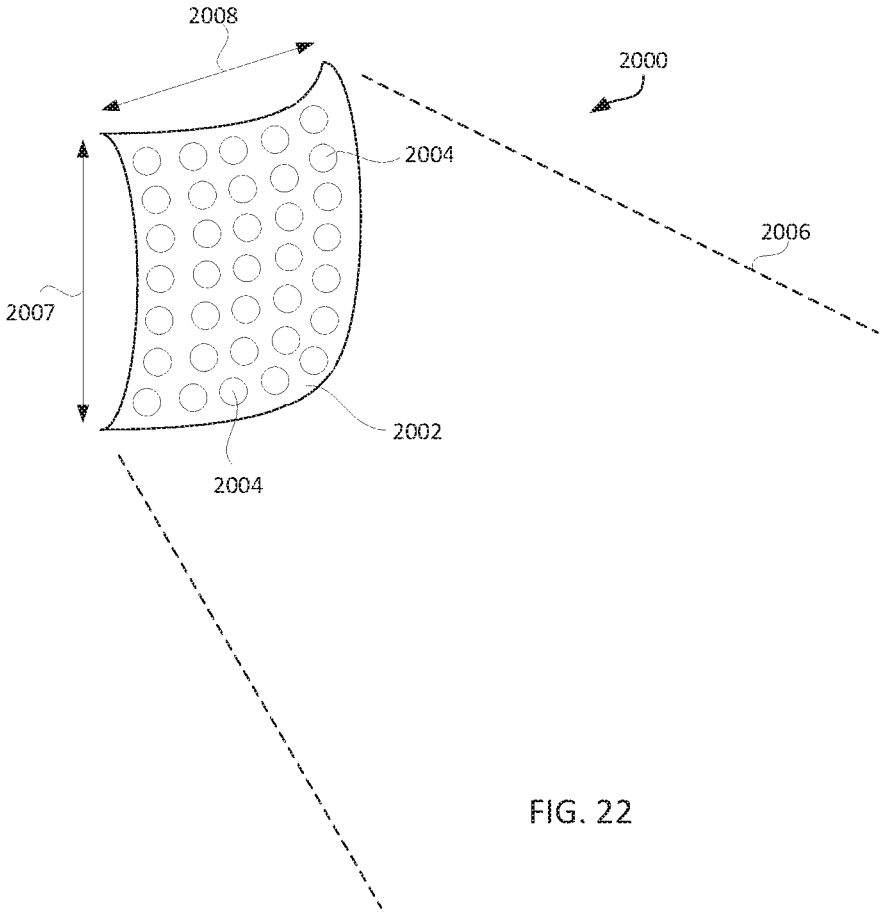
FIG. 22 shows an embodiment of the invention where the directional speaker has a curved surface to expand the beam.

FIG. 22 illustrates one approach to diverge the beam based on an ultrasonic speaker with a convex emitting surface. The surface can be structurally curved in a convex manner to produce a diverging beam. The embodiment shown in FIG. 22 has a spherical-shaped ultrasonic speaker 2000, or an ultrasonic speaker whose emitting surface of ultrasonic output is spherical in shape. In the spherical arrangement, a spherical surface 2002 has a plurality of ultrasonic elements 2004 affixed (e.g. bimorphs) or integral thereto. The ultrasonic speaker with a spherical surface 2002 forms a spherical emitter that outputs an ultrasonic output within a cone (or beam) 2006. Although the cone will normally diverge due to the curvature of the spherical surface 2002, the cone 2006 remains directionally constrained.

Diverging beams can also be generated even if the emitting surface of the ultrasonic speaker is a planar surface. For example, a convex reflector can be used to reflect the beam into a diverging beam (and thus with an increased beam width). In this embodiment, the ultrasonic speaker can be defined to include the convex reflector.

Another way to modify the shape of a beam, so as to diverge or converge the beam, is through controlling phases. In one embodiment, the directional speaker includes a number of speaker elements, such as bimorphs. The phase shifts to individual elements of the speaker can be individually controlled. With the appropriate phase shift, one can generate ultrasonic outputs with a quadratic phase wavefront to produce a converging or diverging beam. For example, the phase of each emitting element is modified by $k*r^2/(2F_0)$, where (a) r is the radial distance of the emitting element from the point where the diverging beam seems to originate from, (b) $F_0$ is the desired focal distance, (c) k—the propagation constant of the audio frequency f—is equal to $2\pi f/c_0$, where $c_0$ is the acoustic velocity.

In yet another example, beam width can be changed by modifying the focal length or the focus of the beam, or by de-focusing the beam. This can be done electronically through adjusting the relative phases of the ultrasonic signals exciting different directional speaker elements.

Still further, the propagation direction of the ultrasonic beam, such as the beam 2006 in FIG. 22, can be changed by electrical and/or mechanical mechanisms. To illustrate based on the spherical-shaped ultrasonic speaker shown in FIG. 22, a user can physically reposition the spherical surface 2002 to change its beam's orientation or direction. Alternatively, a motor can be mechanically coupled to the spherical surface 2002 to change its orientation or the propagation direction of the ultrasonic output. In yet another embodiment, the direction of the beam can be changed electronically based on phase array techniques.

The movement of the spherical surface 2002 to adjust the delivery direction can track user movement. This tracking can be performed dynamically. This can be done through different mechanisms, such as by GPS or other triangulation techniques. The user's position is fed back to or calculated by the directional audio apparatus. The position can then become a beam attribute input. The beam-attribute control unit would convert the input into the appropriate control signals to adjust the delivery direction of the audio output. The movement of the spherical surface 2002 can also be in response to a user input. In other words, the movement or positioning of the beam 2006 can be done automatically or at the instruction of the user.

As another example, a directional speaker can be rotated to cause a change in the direction in which the directionally-constrained audio output outputs are delivered. In one embodiment, a user of an audio system can manually position (e.g., rotate) the directional speaker to adjust the delivery direction. In another embodiment, the directional speaker can be positioned (e.g., rotated) by way of an electrical motor provided within the directional speaker. Such an electrical motor can be controlled by a conventional control circuit and can be instructed by one or more buttons provided on the directional speaker or a remote control device.

Figure 23A:
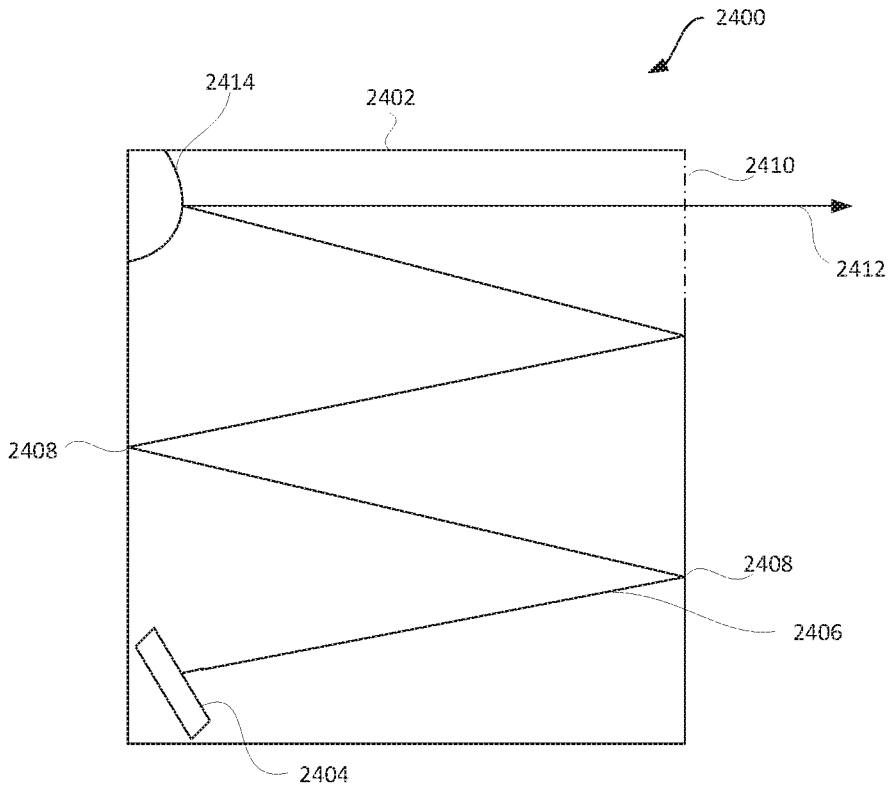
FIGS. 23A-23B show two embodiments of the invention with directional audio delivery devices that allow ultrasonic signals to bounce back and forth before emitting into free space.
Figure 23B:
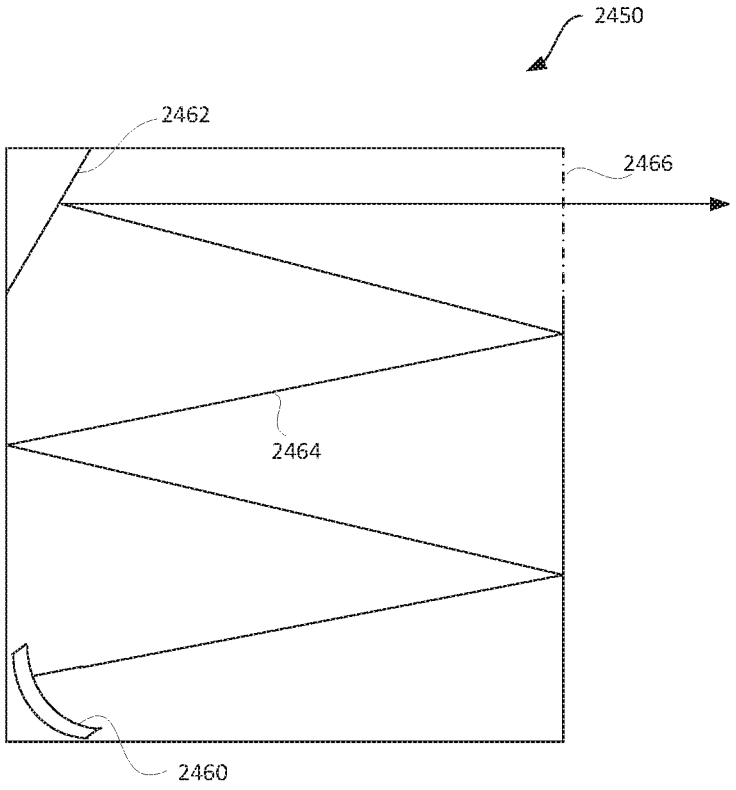

Depending on the power level of the ultrasonic signals, sometimes, it might be beneficial to reduce its level in free space to prevent any potential health hazards, if any. FIGS. 23A-23B show two such embodiments that can be employed, for example, for such a purpose. FIG. 23A illustrates a directional speaker with a planar emitting surface 2404 of ultrasonic output. The dimension of the planar surface can be much bigger than the wavelength of the ultrasonic signals. For example, the ultrasonic frequency is 100 kHz and the planar surface dimension is 15 cm, which is 50 times larger than the wavelength. With a much bigger dimension, the ultrasonic waves emitting from the surface are controlled so that they do not diverge significantly within the enclosure 2402. In the example shown in FIG. 23A, the directional audio delivery device 2400 includes an enclosure 2402 with at least two reflecting surfaces for the ultrasonic waves. The emitting surface 2404 generates the ultrasonic waves, which propagate in a beam 2406. The beam reflects within the enclosure 2402 back and forth at least once by reflecting surfaces 2408. After the multiple reflections, the beam emits from the enclosure at an opening 2410 as the output audio 2412. The dimensions of the opening 2410 can be similar to the dimensions of the emitting surface 2404. In one embodiment, the last reflecting surface can be a concave or convex surface 2414, instead of a planar reflector, to generate, respectively, a converging or diverging beam for the output audio 2412. Also, at the opening 2410, there can be an ultrasonic absorber to further reduce the power level of the ultrasonic output in free space.

FIG. 23B shows another embodiment of a directional audio delivery device 2450 that allows the ultrasonic waves to bounce back and forth at least once by ultrasonic reflecting surfaces before emitting into free space. In FIG. 23B, the directional speaker has a concave emitting surface 2460. The concave surface first focuses the beam and then diverges the beam. For example, the focal point 2464 of the concave surface 2460 is at the mid-point of the beam path within the enclosure. Then with the last reflecting surface 2462 being flat, convex or concave, the beam width at the opening 2466 of the enclosure can be not much larger than the beam width right at the concaved emitting surface 2460. However, at the emitting surface 2460, the beam is converging. While at the opening 2466, the beam is diverging. The curvatures of the emitting and reflecting surfaces can be computed according to the desired focal length or beam divergence angle similar to techniques used in optics, such as in telescopic structures.

Different embodiments or implementations may yield different advantages. One advantage of the invention is that audio output from a directional audio apparatus can be directionally constrained so as to provide directional audio delivery. The directionally-constrained audio output can provide less disturbance to others in the vicinity who are not desirous of hearing the audio output. A number of attributes of the constrained audio outputs can be adjusted, either by a user or automatically and dynamically based on certain monitored or tracked measurements, such as the position of the user.

One adjustable attribute is the direction of the constrained audio outputs. It can be controlled, for example, by (a) activating different segments of a planar or curved speaker surface, (b) using a motor, (c) manually moving the directional speaker, or (d) through phase array beam steering techniques.

Another adjustable attribute is the width of the beam of the constrained audio outputs. It can be controlled, for example, by (a) modifying the frequency of the ultrasonic signals, (b) activating one or more segments of the speaker surface, (c) using phase array beam forming techniques, (d) employing curved speaker surfaces to diverge the beam, (e) changing the focal point of the beam, or (f) de-focusing the beam.

In one embodiment, the degree of isolation or privacy can be controlled independent of the beam width. For example, one can have a wider beam that covers a shorter distance through increasing the frequency of the ultrasonic signals. Isolation or privacy can also be controlled through, for example, (a) phase array beam forming techniques, (b) adjusting the focal point of the beam, or (c) de-focusing the beam.

The volume of the audio output can be modified through, for example, (a) changing the amplitude of the ultrasonic signals driving the directional speakers, (b) modifying the ultrasonic frequency to change its distance coverage, or (c) activating more segments of a planar or curved speaker surface.

The audio output can also be personalized or adjusted based on the audio conditions of the areas surrounding the directional audio apparatus. Signal pre-processing techniques can be applied to the audio signals for such personalization and adjustment.

Ultrasonic hazards, if any, can be minimized by increasing the path lengths of the ultrasonic waves from the directional speakers before the ultrasonic waves emit into free space. There can also be an ultrasonic absorber to attenuate the ultrasonic waves before they emit into free space. Another way to reduce potential hazard, if any, is to increase the frequency of the ultrasonic signals to reduce their distance coverage.

Stereo effects can also be introduced by using more than one directional audio delivery devices that are spaced apart. This will generate multiple and different constrained audio outputs to create stereo effects for a user.

Directionally-constrained audio output outputs can also be generated from a remote control.

In one embodiment, a directional audio conversion apparatus transforms audio input signals into directional audio output signals.

An embodiment is applicable in a moving vehicle, such as a car, a boat or a plane. A directional audio conversion apparatus can be integrated into or attachable to the moving vehicle. As an example, the moving vehicle can be a car. At the front panel or dashboard of the car, there can be a USB, PCMCIA or other types of interface port. The apparatus can be inserted into the port to generate directional audio signals.

In yet another embodiment, one or more directional speakers are incorporated into a moving vehicle. The speakers can be used for numerous applications, such as personal entertainment and communication applications, in the vehicle.

In one embodiment, the directional speaker emits ultrasonic beams. The frequency of the ultrasonic beams can be, for example, in the 40 kHz range, and the beams can be diverging. For example, a 3-cm (diameter) emitter generates an ultrasonic beam that diverges to a 30-cm (diameter) cone after propagating for a distance of 20 to 40 cm. With the diameter of the beams increased by 10 dB, the ultrasonic intensity is reduced by around 20 dB. In another embodiment, the frequency of the beams is at a higher range, such as in the 200 to 500 kHz range. Such higher frequency ultrasonic beams experience higher attenuation in air, such as in the 8 to 40 dB/m range depending on the frequency. In yet another embodiment, the beams with higher ultrasonic frequencies, such as 500 kHz, are diverging beams also. Such embodiments with higher frequencies and diverging beams are suitable to other applications also, such as in areas where the distance of travel is short, for example, 20 cm between the speaker and ear.

Regarding the location of the speaker, it can be mounted directly above where a user should be, such as on the rooftop of the vehicle above the seat. The speaker can be located closer to the back than the front of the seat because when a person sits, the person typically leans on the back of the seat. In another embodiment, the directional speaker is mounted slightly further away, such as at the dome light of a car, with ultrasonic beams directed approximately at the head rest of a user's seat inside the car. For example, one speaker is located in the vicinity of the corner of the dome-light that is closest to the driver, with the direction of the signals, pointing towards the approximate location of the head of the driver. Signals not directly received by the intended recipient, such as the driver, can be scattered by the driver and/or the seat fabrics thereby reducing the intensity of the reflected signals to be received by other passengers in the car.

Instead of emitting ultrasonic signals, in one embodiment, the speakers can emit audio beams, with any directivity depending on the physical structure of the speaker. For example, the speaker is a horn or cone or other similar structure. The directivity of such a speaker depends on the aperture size of the structure. For example, a 10-cm horn has a $\lambda/D$ of about 1 at 3 kHz, and a $\lambda/D$ of about 0.3 at 10 kHz. Thus, at low frequency, such an acoustic speaker offers relatively little directivity. Still, the intensity of the beams goes as $1/R^2$, with R being the distance measured from, for example, the apex of the horn. To achieve isolation, proximity becomes more relevant. In such an embodiment, the speaker is positioned close to the user. Assume that the speaker is placed directly behind the passenger's ears, such as around 10 to 15 cm away. The speaker can be in the head rest or head cushion of the user's seat. Or, the speaker can be in the user's seat, with the beam directed towards the user. If other passengers in the vehicle are spaced at least 1 meter away from the user, based on propagation attenuation (or attenuation as the signals travel in air), the sound isolation effect is around 16 to 20 dB. The structure of the horn or cone can provide additional isolation effect, such as another 6 to 10 dB.

In one embodiment, the user can control one or more attributes of the beams. For example, the user can control the power, direction, distance or coverage of the beams.

Regarding the location of the controls, if the vehicle is a car, the controls can be on the dash board of the vehicle. In another embodiment, the controls are in the armrest of the seat the user is sitting on.

The controls can be mechanical. For example, the speaker is at the dome light, and there can be a rotational mechanism at the dome light area. The rotational mechanism allows the user to adjust the direction of beam as desired. In one embodiment, the rotational mechanism allows two-dimensional rotations. For example, the beams are emitting at a 30 degrees angle from the roof top, and the rotational mechanism allows the beams to be rotated 180 degrees around the front side of the vehicle. In another embodiment, the elevation angle can also be adjusted, such as in the range of 20 to 70 degrees from the roof top.

Another mechanical control can be used to turn the speaker off. For example, when the user stands up from the user's seat, after a preset amount of time, such as 3 seconds, the speaker is automatically turned off.

The controls can also be in a remote controller. The remote controller can use BlueTooth, WiFi, ultrasonic, or infrared or other wireless technologies. The remote controller can also include a fixed or detachable display. The remote controller can be a portable device.

Regarding other attributes of the beam, as to the power level of the signals, the sound level does not have to be too high. For example, the sound level can be about 60 dB SPL at 5 cm away from the speaker.

The content of the signals from the speaker can be accessed in a number of ways. In one embodiment, the content, which can be from a radio station, is wirelessly received by the speaker. For example, the content can be received through the Internet, a WiFi network, a WiMax network, a cell-phone network or other types of networks.

The speaker does not have to receive the content directly from the broadcaster, or the source. In one embodiment, the vehicle receives the content wirelessly from the source, and then through a wired or a wireless connection, the vehicle transmits the content to the speaker.

In yet another embodiment, the content can be selected from a multimedia player, such as a CD player, from the vehicle. The multimedia player can receive from multiple channels to support multiple users in the vehicle. Again, the contents or channels can be received from a broadcast station and selected locally. Or, the content can be created on-demand and streamed to the user demanding it by a wireless server station. In yet another embodiment, the content can be downloaded to a multimedia player from a high-speed wireless network in its entirely before being played.

Another type of control is to select the radio station or a piece of music on a multimedia player. Again, these types of selection control can be from a fixed location in the vehicle, such as there can be control knobs at the dashboard, console, arm rest, door or seat of the vehicle. Or, as another example, the selection controller can be in a portable device.

A number of embodiments have been described regarding one speaker. In yet another embodiment, there can be more than one speaker for a user. The multiple speakers allow the creation of stereo or surround sound effects.

As described regarding the multimedia player, the player can receive from multiple channels to support multiple users in the vehicle. If there is more than one user in the vehicle, each user can have a directional speaker or a set of directional speakers. Regarding the locations of the speakers for multiple users, in one embodiment, they are centralized. All of the speakers are, for example, at the dome light of a vehicle. Each user has a corresponding set of directional beams, radiating from the dome towards the user. Or, the speakers can be distributed. Each user can have a speaker mounted, for example, on the rooftop above where the user should be seating, or in the user's headrest. Regarding control, each user can independently control the signals to that user. For example, a user's controller can control the user's own set of beams, or to select the content of what the user wants to hear. Each user can have a remote controller. In another embodiment, the controller for a user is located at the armrest, seat or door for that user.

Numerous embodiments of the present invention have been applied to an indoor environment, using building layouts. However, many embodiments of the present invention are perfectly suitable for outdoor applications also. For example, a user can be sitting inside a patio reading a book, while listening to music from a directional audio apparatus of the present invention. The apparatus can be outside, such as 10 meters away from the user. Due to the directionally constrained nature of the audio output, sound can still be localized within the direct vicinity of the user. As a result, the degree of noise pollution to the user's neighbors is significantly reduced.

In one embodiment, an existing audio system can be modified with one of the described embodiments to generate directionally-constrained audio output outputs. A user can select either directionally constrained or normal audio outputs from the audio system, as desired.

The various embodiments, implementations and features of the invention noted above can be combined in various ways or used separately. Those skilled in the art will understand from the description that the invention can be equally applied to or used in other various different settings with respect to various combinations, embodiments, implementations or features provided in the description herein.

The invention can be implemented in software, hardware or a combination of hardware and software. A number of embodiments of the invention can also be embodied as computer readable code on a computer readable medium. The computer readable medium is any data storage device that can store data, which can thereafter be read by a computer system. Examples of the computer readable medium include read-only memory, random-access memory, CD-ROMs, magnetic tape, optical data storage devices, and carrier waves. The computer readable medium can also be distributed over network-coupled computer systems so that the computer readable code is stored and executed in a distributed fashion.

Numerous specific details are set forth in order to provide a thorough understanding of the invention. However, it will be understood by those skilled in the art that the invention may be practiced without these specific details. The description and representation herein are the common meanings used by those experienced or skilled in the art to most effectively convey the substance of their work to others skilled in the art. In other instances, well-known methods, procedures, components, and circuitry have not been described in detail to avoid unnecessarily obscuring aspects of the present invention.

Also, in this specification, reference to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments mutually exclusive of other embodiments. Further, the order of blocks in process flowcharts or diagrams representing one or more embodiments of the invention do not inherently indicate any particular order nor imply any limitations in the invention.

Other embodiments of the invention will be apparent to those skilled in the art from a consideration of this specification or practice of the invention disclosed herein. It is intended that the specification and examples be considered as exemplary only, with the true scope and spirit of the invention being indicated by the following claims.

What is claimed is:

1. An electronic system operable at least to generate sound for a vehicle comprising:

an ultrasonic speaker attached to the vehicle configured to generate ultrasonic signals, which are transformed into audio signals, wherein the audio signals are directional in at least a direction towards a user in the vehicle, and wherein the audio signals are first audio signals;

a non-ultrasonic speaker attached to the vehicle configured to generate audio signals, without the need to be transformed from ultrasonic signals, wherein the audio signals are second audio signals; and a controller that is electrically coupled to the ultrasonic speaker and the non-ultrasonic speaker, wherein the controller is configured to control the electronic system to operate in at least a mode selected from a first mode and a second mode, wherein in the first mode, the electronic system is configured to at least output the first audio signals, and wherein in the second mode, the electronic system is configured to at least output the second audio signals.

2. An electronic system as recited in claim 1, wherein the controller is configured to control the electronic system to at least output the first audio signals and the second audio signals together.

3. An electronic system as recited in claim 2, wherein the frequencies of at least a part of the second audio signals are less than all the frequencies of the first audio signals.

4. An electronic system as recited in claim 2, wherein the ultrasonic speaker is configured to be in the vicinity of the roof above a seat of the vehicle, with the seat for the user.

5. An electronic system as recited in claim 4, wherein the electronic system includes another ultrasonic speaker configured to generate another directional audio signals, which are directional in at least a direction towards another user in the vehicle, and wherein the another ultrasonic speaker is configured to be in the vicinity of the roof above another seat of the vehicle, with the another seat for the another user.

6. An electronic system as recited in claim 2, wherein the ultrasonic speaker is configured to be in a headrest of a seat of the vehicle, with the seat for the user.

7. An electronic system as recited in claim 6, wherein the electronic system includes another ultrasonic speaker configured to generate another directional audio signals, which are directional in at least a direction towards another user in the vehicle, and wherein the another ultrasonic speaker is configured to be in a headrest of another seat of the vehicle, with the another seat for the another user.

8. An electronic system as recited in claim 2, wherein the ultrasonic speaker is configured to generate the ultrasonic signals from at least a portion of audio input signals, and wherein at least a portion of the audio input signals are configured to be wirelessly received from a cell-phone.

9. An electronic system as recited in claim 8 comprising at least a directional microphone configured to receive inputs from the user, wherein the directional microphone is configured to be directed towards the user.

10. An electronic system as recited in claim 2, wherein the ultrasonic speaker is configured to generate the ultrasonic signals from at least a portion of audio input signals, wherein at least a portion of the audio input signals are configured to be wirelessly received from a cell-phone, and wherein the electronic system includes another ultrasonic speaker configured to generate another directional audio signals from at least a piece of music wirelessly received, the another directional audio signals being directional in at least a direction towards another user in the vehicle.

11. An electronic system operable at least to generate audio output signals from audio input signals for a vehicle comprising:

a directional speaker attached to the vehicle configured to generate directional audio signals from a first portion of the audio input signals, wherein the directional audio signals are directional in at least a direction towards a user in the vehicle; and another speaker attached to the vehicle configured to generate another audio signals from a second portion of the audio input signals, wherein the frequencies of at least a part of the another audio signals are less than all the frequencies of the directional audio signals, and wherein at least the directional audio signals together with the another audio signals form the audio output signals.

12. An electronic system as recited in claim 11, wherein the directional speaker is configured to be in the vicinity of the roof above a seat of the vehicle, with the seat for the user.

13. An electronic system as recited in claim 12, wherein the electronic system includes another directional speaker configured to generate another directional audio signals, which are directional in at least a direction towards another user in the vehicle, and wherein the another directional speaker is configured to be in the vicinity of the roof above another seat of the vehicle, with the another seat for the another user.

14. An electronic system as recited in claim 11, wherein the directional speaker is configured to be in a headrest of a seat of the vehicle, with the seat for the user.

15. An electronic system as recited in claim 14, wherein the electronic system includes another directional speaker configured to generate another directional audio signals, which are directional in at least a direction towards another user in the vehicle, and wherein the another directional speaker is configured to be in a headrest of another seat of the vehicle, with the another seat for the another user.

16. An electronic system as recited in claim 11, wherein at least a portion of the audio input signals are configured to be wirelessly received from a cell-phone.

17. An electronic system as recited in claim 16 comprising at least a directional microphone configured to receive inputs from the user, wherein the directional microphone is configured to be directed towards the user.

18. An electronic system as recited in claim 11, wherein the electronic system includes another directional speaker configured to generate another directional audio signals from at least a piece of music wirelessly received, the another directional audio signals being directional in at least a direction towards another user in the vehicle, and wherein at least a portion of the audio input signals are configured to be wirelessly received from a cell-phone.

19. A computer-implemented method to at least generate first audio signals and second audio signals for a vehicle, based on at least an electronic system attached to the vehicle, the electronic system including at least an ultrasonic speaker and a non-ultrasonic speaker, both electrically coupled to a controller, the method comprising:

controlling, by the controller, the electronic system to operate in at least a mode selected form a first mode and a second mode;

generating, by the ultrasonic speaker, ultrasonic signals, to be outputted by the electronic system, with the ultrasonic signals being transformed into the first audio signals, if the electronic system is configured to operate in the first mode; and generating, by the non-ultrasonic speaker, the second audio signals, to be outputted by the electronic system, with the generating without the need to be transformed from ultrasonic signals, if the electronic system is configured to operate in the second mode, wherein the first audio signals are directional in at least a direction towards a user in the vehicle.

20. A computer-implemented method to at least generate audio output signals from audio input signals for a vehicle, based on at least an electronic system, the electronic system including at least a directional speaker attached to the vehicle and another speaker attached to the vehicle, the method comprising:

generating directional audio signals from a first portion of the audio input signals, wherein the directional audio signals are directional in at least a direction towards a user in the vehicle; and generating another audio signals from a second portion of the audio input signals, wherein the frequencies of at least a part of the another audio signals are less than all the frequencies of the directional audio signals, and wherein at least the directional audio signals together with the another audio signals form the audio output signals.

* * * * *